US009325085B2

(12) United States Patent
Tanaka et al.

(10) Patent No.: US 9,325,085 B2
(45) Date of Patent: Apr. 26, 2016

(54) CONNECTION STRUCTURE OF ELECTRIC WIRE AND TERMINAL, AND MANUFACTURING METHOD THEREOF

(71) Applicant: YAZAKI CORPORATION, Tokyo (JP)

(72) Inventors: Shinya Tanaka, Shizuoka (JP); Hisashi Hanazaki, Shizuoka (JP); Hironori Kitagawa, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 139 days.

(21) Appl. No.: 13/895,095

(22) Filed: May 15, 2013

(65) Prior Publication Data

US 2013/0252459 A1 Sep. 26, 2013

Related U.S. Application Data

(63) Continuation of application No. PCT/JP2011/077871, filed on Nov. 25, 2011.

(30) Foreign Application Priority Data

Nov. 26, 2010 (JP) ..... 2010-263601
Jan. 20, 2011 (JP) ..... 2011-009438

(51) Int. Cl.
*H01R 13/58* (2006.01)
*H01R 4/62* (2006.01)
(Continued)

(52) U.S. Cl.
CPC ..... *H01R 4/62* (2013.01); *H01R 4/185* (2013.01); *H01R 43/005* (2013.01); *H01R 43/05* (2013.01); *H01R 4/72* (2013.01); *H01R 13/5216* (2013.01); *Y10T 29/49192* (2015.01)

(58) Field of Classification Search
CPC ..... H01R 4/72; H01R 13/5845; H01R 43/24
USPC ..... 439/523, 604, 886, 606
See application file for complete search history.

(56) References Cited

U.S. PATENT DOCUMENTS 3,324,441 A 6/1967 Olsen et al.
4,314,737 A * 2/1982 Bogese et al. ..... 439/425
(Continued)

FOREIGN PATENT DOCUMENTS

CN 1387286 A 12/2002
CN 101237109 A 8/2008
(Continued)

OTHER PUBLICATIONS

Office Action for Japanese Patent App. No. 2011-009438 (Sep. 30, 2014).
(Continued)

*Primary Examiner* — Hae Moon Hyeon
(74) *Attorney, Agent, or Firm* — Kenealy Vaidya LLP

(57) ABSTRACT

A connection structure of an electric wire and a terminal includes the electric wire, the terminal, and a seal part. The electric wire has an insulating coated part in which a conductor part is covered with an insulating material, and a conductor exposed part in which the insulating material of an end of the electric wire is removed. The terminal includes a first crimp part crimped to the insulating coated part, and a second crimp part crimped to the conductor exposed part. The seal part is made of thermoplastic elastomer and covers a surface including the first crimp part and the insulating coated part of a side extending from said first crimp part toward a direction opposite to the end of the electric wire and a surface of the second crimp part in an extension direction of the electric wire.

7 Claims, 25 Drawing Sheets

(51) Int. Cl.

| | |
|---|---|
| ***H01R 4/18*** | (2006.01) |
| ***H01R 43/00*** | (2006.01) |
| ***H01R 43/05*** | (2006.01) |
| *H01R 4/72* | (2006.01) |
| *H01R 13/52* | (2006.01) |

(56) References Cited

U.S. PATENT DOCUMENTS

| | | | | |
|---|---|---|---|---|
| 5,123,864 | A | 6/1992 | Karlovich | |
| 6,613,263 | B2 * | 9/2003 | Kondo | 264/263 |
| 6,749,457 | B2 * | 6/2004 | Sakaguchi | H01R 4/188 439/421 |
| 6,981,897 | B2 * | 1/2006 | Sakatani | 439/606 |
| 7,044,813 | B2 * | 5/2006 | Amara et al. | 439/877 |
| 7,690,954 | B2 * | 4/2010 | Watanabe et al. | 439/730 |
| 8,167,666 | B2 * | 5/2012 | Koga | H01R 4/185 439/595 |
| 8,360,803 | B2 * | 1/2013 | Sakai | 439/523 |
| 8,607,449 | B2 * | 12/2013 | Kitagawa et al. | 29/863 |
| 2001/0003687 | A1 | 6/2001 | Kondo | |
| 2002/0119700 | A1 * | 8/2002 | Murakami | 439/606 |
| 2002/0127915 | A1 * | 9/2002 | Kondo | 439/606 |
| 2002/0171207 | A1 | 11/2002 | Torii et al. | |
| 2003/0013353 | A1 * | 1/2003 | Sakaguchi | H01R 4/188 439/877 |
| 2008/0185169 | A1 | 8/2008 | Daito | |
| 2008/0283268 | A1 | 11/2008 | Iwasaki et al. | |
| 2009/0186507 | A1 | 7/2009 | Watanabe et al. | |
| 2013/0225014 | A1 | 8/2013 | Sato et al. | |
| 2013/0303019 | A1 | 11/2013 | Ito et al. | |
| 2013/0344752 | A1 | 12/2013 | Takayama et al. | |
| 2014/0011411 | A1 | 1/2014 | Matsushita | |

FOREIGN PATENT DOCUMENTS

| | | | |
|---|---|---|---|
| CN | 101248558 | A | 8/2008 |
| DE | 19845098 | A1 | 4/2000 |
| EP | 1796216 | A1 | 6/2007 |
| EP | 2083480 | A2 | 7/2009 |
| JP | 07-335282 | A | 12/1995 |
| JP | 2000-285983 | A | 10/2000 |
| JP | 2010-34170 | A | 2/2010 |
| JP | 2010-108829 | A | 5/2010 |
| KR | 10-2013-0080039 | A | 7/2013 |
| KR | 10-2013-0109225 | A | 10/2013 |
| KR | 10-2013-0122668 | A | 11/2013 |
| KR | 10-2013-0126735 | A | 11/2013 |

OTHER PUBLICATIONS

Korean Office Action for the related Korean Patent Application No. 10-2013-7013159 dated Sep. 30, 2014.

International Search Report and Written Opinion of the International Search Report for PCT/J132011/077871 dated Feb. 24, 2012.

Chinese Office Action for related Chinese Patent App. No. 201180056964.2 dated Jan. 14, 2015.

Korean Office Action for related Korean Patent App. No. 10-2013-7013159 dated Mar. 20, 2015.

Chinese Office Action for the related Chinese Patent Application No. 201180056964.2 dated Sep. 9, 2015.

European Office Action for the related European Patent Application No. 11 802 545.1-1801 dated Feb. 19, 2016.

* cited by examiner

CONNECTION STRUCTURE OF ELECTRIC WIRE AND TERMINAL, AND MANUFACTURING METHOD THEREOF

CROSS REFERENCE TO RELATED APPLICATION

This application is a continuation of PCT application No. PCT/JP2011/077871, which was filed on Nov. 25, 2011 based on Japanese Patent Applications Nos. 2010-263601 filed on Nov. 26, 2010, and 2011-009438 filed on Jan. 20, 2011, the contents of which are incorporated herein by reference.

BACKGROUND OF THE INVENTION

1. Technical Field

The present invention relates to a connection structure of an electric wire and a terminal, and particularly to a connection structure of an electric wire having a core wire made of aluminum and a terminal made of metal different from that of the core wire, and a manufacturing method of the structure of connection.

2. Background Art

A signal line or a power line in which an electric wire having a core wire made of a copper material is connected to a terminal made of a copper material has conventionally been used in an automobile, a home appliance, etc.

On the other hand, the automobile industry has a problem important to improve fuel efficiency by reducing vehicle weight out of consideration for environment. Because of this, an electric wire using aluminum more lightweight than copper as a material of a core wire receives attention.

However, aluminum tends to corrode in the presence of water and copper ions, so that there was a problem of tending to corrode when water enters the portion of connection between the core wire made of aluminum and a terminal made of copper.

Hence, a connection structure of an electric wire and a terminal, in which the structure is made waterproof and corrosion is prevented by covering the portion of connection between the core wire made of aluminum and the terminal made of copper with resin, is proposed (for example, see Patent Literature 1).

The connection structure of the electric wire and the terminal described in this Patent Literature 1 includes the terminal, a conductor which is made of metal different from that of the terminal and is connected to the terminal by crimping a conductor part and an insulating coated part, and a resin layer applied so as to seal and cover at least a part of the terminal and the conductor part exposed from the terminal.

CITATION LIST

Patent Literature 1: JP-A-2010-108829

However, in the connection structure of the electric wire and the terminal described in this Patent Literature 1, the resin is locally formed, so that there was a problem that when an external force is applied, the portion of adhesion between the resin and the terminal tends to peel and water enters the peeling portion and consequently corrosion-proof properties of the connection structure of the electric wire and the terminal reduce.

The invention has been implemented in view of the above, and an object of the invention is to provide a connection structure of an electric wire and a terminal capable of improving corrosion-proof properties.

SUMMARY OF THE INVENTION

In order to solve the problems described above and achieve the object, a connection structure of an electric wire and a terminal according to the first aspect of the invention has the electric wire having an insulating coated part in which a conductor part is covered with an insulating material, and a conductor exposed part in which the insulating material of an end of the electric wire is removed, the terminal including a first crimp part crimped to the insulating coated part, and a second crimp part crimped to the conductor exposed part, and a seal part which is made of thermoplastic elastomer and covers a surface including the first crimp part and the insulating coated part of a side extending from the first crimp part toward a direction opposite to the end of the electric wire and a surface of the second crimp part in an extension direction of the electric wire, such that an outer periphery of the electric wire is seamlessly covered with the seal part when viewed in a cross section orthogonal to the extension direction of the electric wire.

Also, in the invention described above, a connection structure of an electric wire and a terminal according to the second aspect of the invention is characterized in that the terminal has a box shape and has a notched part in which a notch is formed in an upper part between the first crimp part and the second crimp part, and an outer periphery of the electric wire in the notched part is seamlessly covered with the seal part when viewed in a cross section orthogonal to the extension direction of the electric wire.

Also, in the invention described above, a connection structure of an electric wire and a terminal according to the third aspect of the invention is characterized in that the terminal has a box shape and an opening is formed in a side wall covered with the seal part.

Also, in the invention described above, a connection structure of an electric wire and a terminal according to the fourth aspect of the invention is characterized in that a surface of the insulating coated part of a side extending from the first crimp part toward a direction opposite to an end of the electric wire has an uneven shape by roughening treatment.

Also, in the invention described above, a connection structure of an electric wire and a terminal according to the fifth aspect of the invention is characterized in that in the terminal and the insulating coated part of a side extending from the first crimp part toward a direction opposite to an end of the electric wire, a substrate with improved adhesion is formed on a surface by applying a primer agent.

Also, in the invention described above, a connection structure of an electric wire and a terminal according to the sixth aspect of the invention is characterized in that the first crimp part is formed so as to increase a cross-sectional area orthogonal to an extension direction of the electric wire surrounded by the first crimp part.

Also, in the invention described above, a connection structure of an electric wire and a terminal according to the seventh aspect of the invention is characterized in that an external shape of a cross section orthogonal to an extension direction of the electric wire is a rectangular shape in the first crimp part.

Also, in the invention described above, a connection structure of an electric wire and a terminal according to the eighth aspect of the invention is characterized in that the conductor part is made of aluminum, and the terminal is made of metal different from that of the conductor part.

In order to solve the problems described above and achieve the object, a manufacturing method of a connection structure of an electric wire and a terminal according to the ninth aspect of the invention is the manufacturing method of the connection structure of the electric wire and the terminal, the structure having the electric wire having an insulating coated part in which a conductor part is covered with an insulating material, and a conductor exposed part in which the insulating material of an end of the electric wire is removed, and the terminal including a first crimp part crimped to the insulating coated part, and a second crimp part crimped to the conductor exposed part, and is characterized by including a seal part formation step of forming a seal part which is made of thermoplastic elastomer and covers a surface including the first crimp part and the insulating coated part of a side extending from the first crimp part toward a direction opposite to the end of the electric wire and a surface of the second crimp part in an extension direction of the electric wire so as to seamlessly cover an outer periphery of the electric wire when viewed in a cross section orthogonal to the extension direction thereof by a metallic mold, the seal part formation step in which a gate of the metallic mold is arranged separately from a formation position of an end of the seal part toward the extension direction of the electric wire and the inside of the metallic mold is filled with the seal part.

Also, in the invention described above, a manufacturing method of a connection structure of an electric wire and a terminal according to the tenth aspect of the invention is characterized in that in the seal part formation step, the gate is arranged in a surface extending to an end of the electric wire.

In order to solve the problems described above and achieve the object, a manufacturing method of a connection structure of an electric wire and a terminal according to the eleventh aspect of the invention is the manufacturing method of the connection structure of the electric wire and the terminal, the structure having the electric wire having an insulating coated part in which a conductor part is covered with an insulating material, and a conductor exposed part in which the insulating material of an end of the electric wire is removed, and the box-shaped terminal having a first crimp part crimped to the insulating coated part, a second crimp part crimped to the conductor exposed part, and a notched part in which a notch is formed in an upper part between the first crimp part and the second crimp part, and is characterized by including a crimping step of crimping the first crimp part or the second crimp part while covering the notched part together with the first crimp part or the second crimp part with a crimp surface of crimp means in the case of crimping the first crimp part or the second crimp part by pressing the crimp surface of the crimp means, and a seal part formation step of forming a seal part which is made of thermoplastic elastomer and covers a surface including the first crimp part and the insulating coated part of a side extending from the first crimp part toward a direction opposite to the end of the electric wire, a surface of the second crimp part and a surface of the notched part in an extension direction of the electric wire so as to seamlessly cover an outer periphery of the electric wire when viewed in a cross section orthogonal to the extension direction thereof by a metallic mold.

The connection structure of the electric wire and the terminal according to the first aspect of the invention has the seal part which is made of thermoplastic elastomer and covers the surface including the first crimp part and the insulating coated part of the side extending from the first crimp part toward the direction opposite to the end of the electric wire and the surface of the second crimp part in the extension direction of the electric wire, and the outer periphery of the electric wire is seamlessly covered with the seal part when viewed in a cross section orthogonal to the extension direction of the electric wire, so that peeling of the seal part by an external force can be prevented to increase waterproof properties, with the result that corrosion-proof properties can be improved.

The connection structure of the electric wire and the terminal according to the second aspect of the invention has the seal part which is made of thermoplastic elastomer and covers the surface including the first crimp part and the insulating coated part of the side extending from the second crimp part toward the direction opposite to the end of the electric wire, the surface of the second crimp part and the notched part in the extension direction of the electric wire, and the outer periphery of the electric wire is seamlessly covered with the seal part when viewed in a cross section orthogonal to the extension direction, so that peeling of the seal part by an external force can be prevented to increase waterproof properties, with the result that corrosion-proof properties can be improved.

In the connection structure of the electric wire and the terminal according to the third aspect of the invention, while having an effect similar to the first aspect of the invention described above, the seal part of the inside and the outside of the side wall of the terminal is joined through the seal part with which the opening part is filled, so that the seal part functions as a holding part of the seal part with respect to an external force, and peeling of the seal part can be prevented.

In the connection structure of the electric wire and the terminal according to the fourth aspect of the invention, while having an effect similar to the first aspect of the invention described above, the surface of the insulating part covered with the seal part has the uneven shape, so that a surface area of a surface of adhesion between the insulating part and the seal part increases and also the strength of adhesion between the insulating part and the seal part improves by an anchor effect caused by entrance of the seal part into recesses of the surface of the insulating part.

In the connection structure of the electric wire and the terminal according to the fifth aspect of the invention, while having an effect similar to the first aspect of the invention described above, the strength of adhesion between the insulating coated part and the seal part and also between the terminal and the seal part is improved by forming the substrate on the surface of the insulating coated part covered with the seal part. As a result, peeling of the seal part can be prevented to increase waterproof properties, with the result that corrosion-proof properties can be improved.

In the connection structure of the electric wire and the terminal according to the sixth aspect of the invention, while having an effect similar to the first aspect of the invention described above, the first crimp part is formed so as to increase the cross-sectional area orthogonal to the extension direction of the electric wire surrounded by the first crimp part, so that the insulating part is prevented from swelling in the vicinity of the portion of crimping the first crimp part and a thickness of the seal part is prevented from becoming thin in this swelling portion, so that waterproof properties can be increased, with the result that corrosion-proof properties can be improved.

In the connection structure of the electric wire and the terminal according to the seventh aspect of the invention, while having an effect similar to the first aspect of the invention described above, the structure is constructed so as to increase the cross-sectional area orthogonal to the extension direction of the electric wire surrounded by the first crimp part, so that the insulating part is prevented from swelling in the vicinity of the portion of crimping the first crimp part and a thickness of the seal part is prevented from becoming thin in this swelling portion, so that waterproof properties can be increased, with the result that corrosion-proof properties can be improved.

In the connection structure of the electric wire and the terminal according to the eighth aspect of the invention, while having an effect similar to the first aspect of the invention described above, also in the case of using aluminum in the conductor part, peeling of the seal part can be prevented to increase waterproof properties, with the result that corrosion-proof properties can be improved.

Since the manufacturing method of the connection structure of the electric wire and the terminal according to the ninth aspect of the invention forms the seal part which is made of thermoplastic elastomer and covers the surface including the first crimp part and the insulating coated part of the side extending from the first crimp part toward the direction opposite to the end of the electric wire and the surface of the second crimp part in the extension direction of the electric wire so as to seamlessly cover the outer periphery of the electric wire when viewed in a cross section orthogonal to the extension direction thereof by the metallic mold, while having an effect similar to the first aspect of the invention described above, occurrence of peeling of the seal part in the vicinity of the gate of the metallic mold can be prevented to increase waterproof properties, with the result that corrosion-proof properties can be improved.

In the manufacturing method of the connection structure of the electric wire and the terminal according to the tenth aspect of the invention, while having an effect similar to the ninth aspect of the invention described above, thermoplastic elastomer becomes easy to flow by an effect of a step by the end of the electric wire, so that filling properties are not reduced.

Since the manufacturing method of the connection structure of the electric wire and the terminal according to the eleventh aspect of the invention forms the seal part which is made of thermoplastic elastomer and covers the surface including the first crimp part and the insulating coated part of the side extending from the first crimp part toward the direction opposite to the end of the electric wire, the surface of the second crimp part and the surface of the notched part in the extension direction of the electric wire so as to seamlessly cover the outer periphery of the electric wire when viewed in a cross section orthogonal to the extension direction thereof by the metallic mold, while having an effect similar to the second aspect of the invention described above, the first crimp part is crimped while covering the notched part with the crimp surface of the first crimp part by increasing the width of the first crimp part, so that the notched part can be prevented from swelling. As a result, a thickness of the seal part is prevented from becoming thin, so that waterproof properties can be increased, with the result that corrosion-proof properties can be improved.

DETAILED DESCRIPTION OF THE EXEMPLARY EMBODIMENTS

Preferred embodiments of a connection structure of an electric wire and a terminal according to the invention and a manufacturing method of the structure of connection will hereinafter be described in detail with reference to the drawings.

(First Embodiment)

Figure 1:
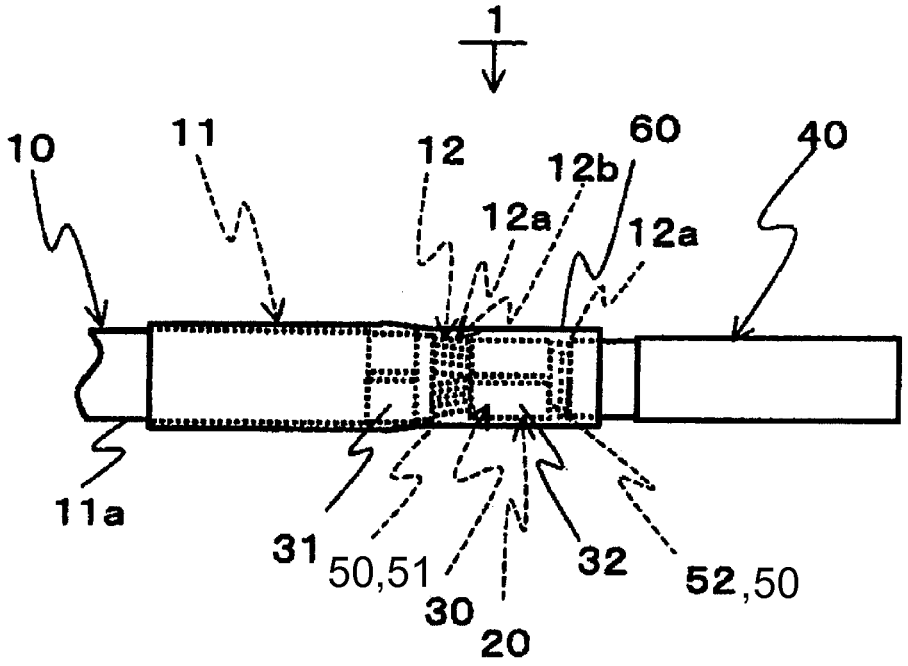
FIG. 1 is a plan view showing a connection structure of an electric wire and a terminal according to a first embodiment of the invention.
Figure 2:
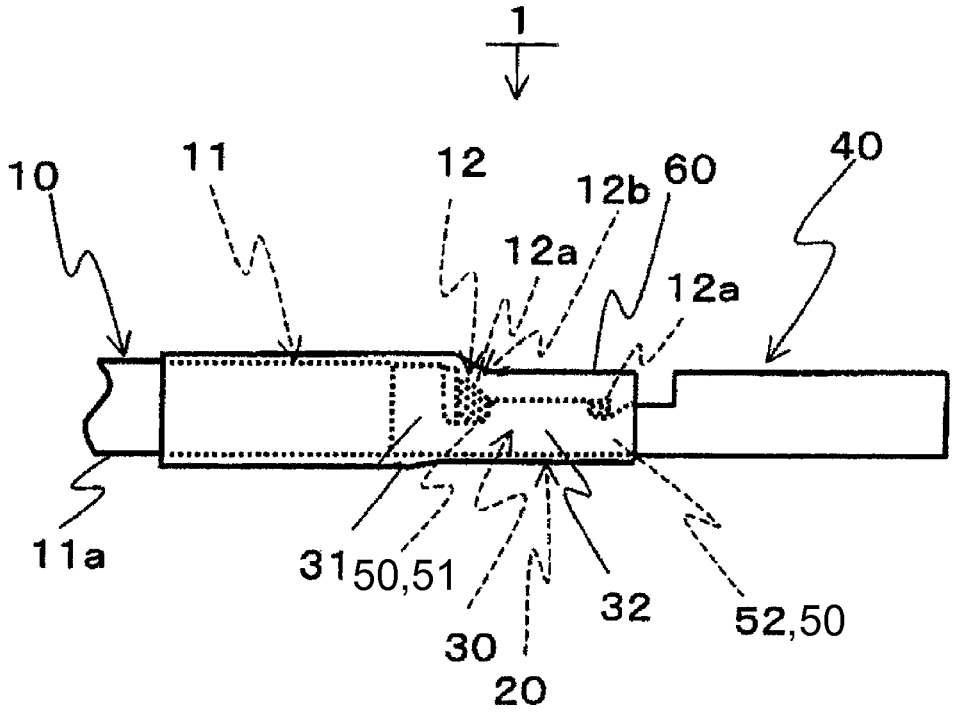
FIG. 2 is a side view showing the connection structure of the electric wire and the terminal according to the first embodiment of the invention.

FIG. 1 is a plan view showing a connection structure 1 of an electric wire and a terminal according to a first embodiment of the invention. FIG. 2 is a side view showing the connection structure 1 of the electric wire and the terminal according to the embodiment of the invention. The connection structure 1 of the electric wire and the terminal has an electric wire 10, a terminal 20 and a seal part 60.

The electric wire 10 has an insulating coated part 11 and a conductor exposed part 12.

The insulating coated part 11 is the portion in which a conductor part 12*b* obtained by bundling plural core wires 12*a* made of an aluminum material is coated with an insulating part 11*a* made of an insulating material such as polypropylene (PP). In addition, the insulating part 11*a* is not limited to polypropylene and other insulating materials may be used.

The conductor exposed part 12 is the portion in which the insulating part 11*a* of the end of the electric wire 10 is removed and the conductor part 12*b* is exposed.

The terminal 20 has a box shape made of copper. This terminal 20 is formed by, for example, pressing a copper plate. The terminal 20 has an electric wire connection part 30, another terminal connection part 40 and a notched part 50.

The electric wire connection part 30 has an insulation barrel 31 as a first crimp part, and a wire barrel 32 as a second crimp part.

The insulation barrel 31 is the portion crimped to the insulating coated part 11 of the electric wire 10 by, for example, a crimper and an anvil.

The wire barrel 32 is the portion crimped by, for example, a crimper and an anvil to the conductive wire part 12 exposed by removing the insulating coated part 11 of the electric wire 10.

The other terminal connection part 40 has a box shape, and is the portion electrically connected to a male terminal used as the connection other side.

The notched part 50 has a box shape in which a notch is formed in the upper part. This notched part 50 has a first notched part 51 and a second notched part 52. The first notched part 51 is a notched part formed between the insulation barrel 31 and the wire barrel 32. The second notched part 52 is a notched part formed between the wire barrel 32 and the other terminal connection part 40.

The seal part 60 is made of thermoplastic elastomer and is formed using a metallic mold. This seal part 60 is formed so as to cover a surface including the insulation barrel 31 and the insulating coated part 11 of the side extending from the insulation barrel 31 toward a direction opposite to the end of the electric wire 10, a surface of the wire barrel 32, a surface of the first notched part 51 and the second notched part 52 in an extension direction of the electric wire 10. Also, the outer periphery of the electric wire 10 is integrally covered with the seal part 60 when viewed in a cross section orthogonal to the extension direction. That is, the outer periphery of the electric wire 10 is seamlessly covered with the seal part 60 when viewed in a cross section orthogonal to the extension direction.

Also, the seal part 60 is formed so as not to have seams of the surface including the insulation barrel 31 and the insulating coated part 11 of the side extending from the insulation barrel 31 toward the direction opposite to the end of the electric wire 10, the surface of the wire barrel 32, the surface of the first notched part 51 and the second notched part 52 in the extension direction of the electric wire 10.

In this embodiment, thermoplastic elastomer with a high intermolecular force to a material used in the insulating coated part 11 is used as the seal part 60.

Here, the intermolecular force between molecules of the insulating material for forming the insulating part 11*a* of the insulating coated part 11 and elastomer molecules of the thermoplastic elastomer will be described. FIG. 3 is a diagram describing a relation between a molecular size and the intermolecular force.

In the connection structure 1 of the electric wire 10 and the terminal 20, it is necessary to improve adhesion between the insulating part 11*a* and the seal part 60 in order to withstand repeated bends of the electric wire 10.

Because of this, a kind of thermoplastic elastomer is selected according to the required quality of bend durability etc. of the electric wire 10 and the terminal 20. That is, the strength of adhesion between the seal part 60 and the terminal 20 or the strength of adhesion between the seal part 60 and the insulating part 11*a* is set by selecting the kind of thermoplastic elastomer. For example, when the required quality of bend is high, it is necessary to increase the strength of adhesion between the seal part 60 and the insulating part 11*a*, so that the thermoplastic elastomer in which a strong intermolecular force acts on the insulating part 11*a* is selected.

Figure 3A:
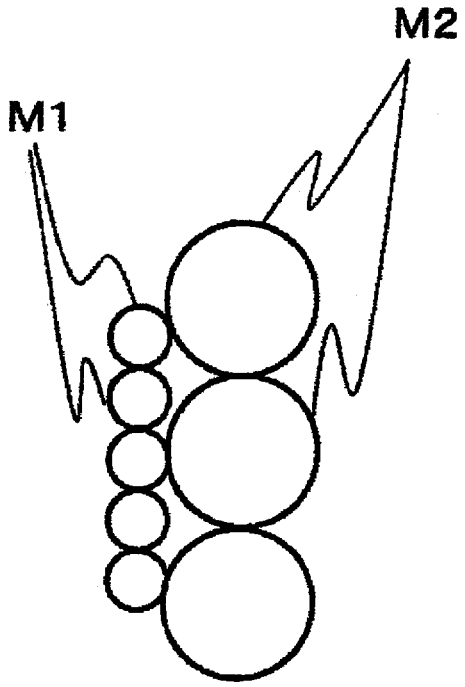
FIGS. 3A and 3B are diagrams describing a relation between a molecular size and an intermolecular force.
Figure 3B:
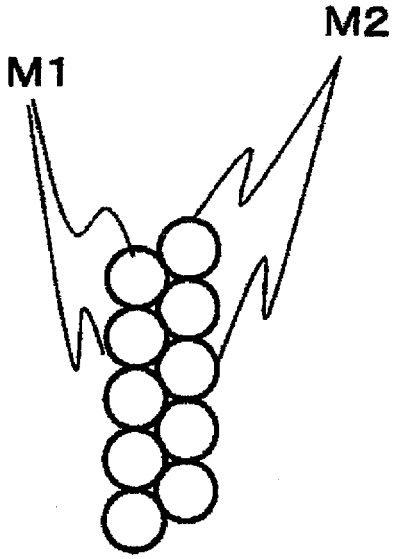

In addition, in the intermolecular force between molecules M1 of the material for forming the insulating part 11*a* and elastomer molecules M2 of the thermoplastic elastomer, a stronger intermolecular force can be obtained since a gap in the case where sizes of both the molecules are equal (FIG. 3B) becomes smaller than a gap in the case where the sizes of both the molecules differ (FIG. 3A) as shown in FIG. 3.

Figure 4:
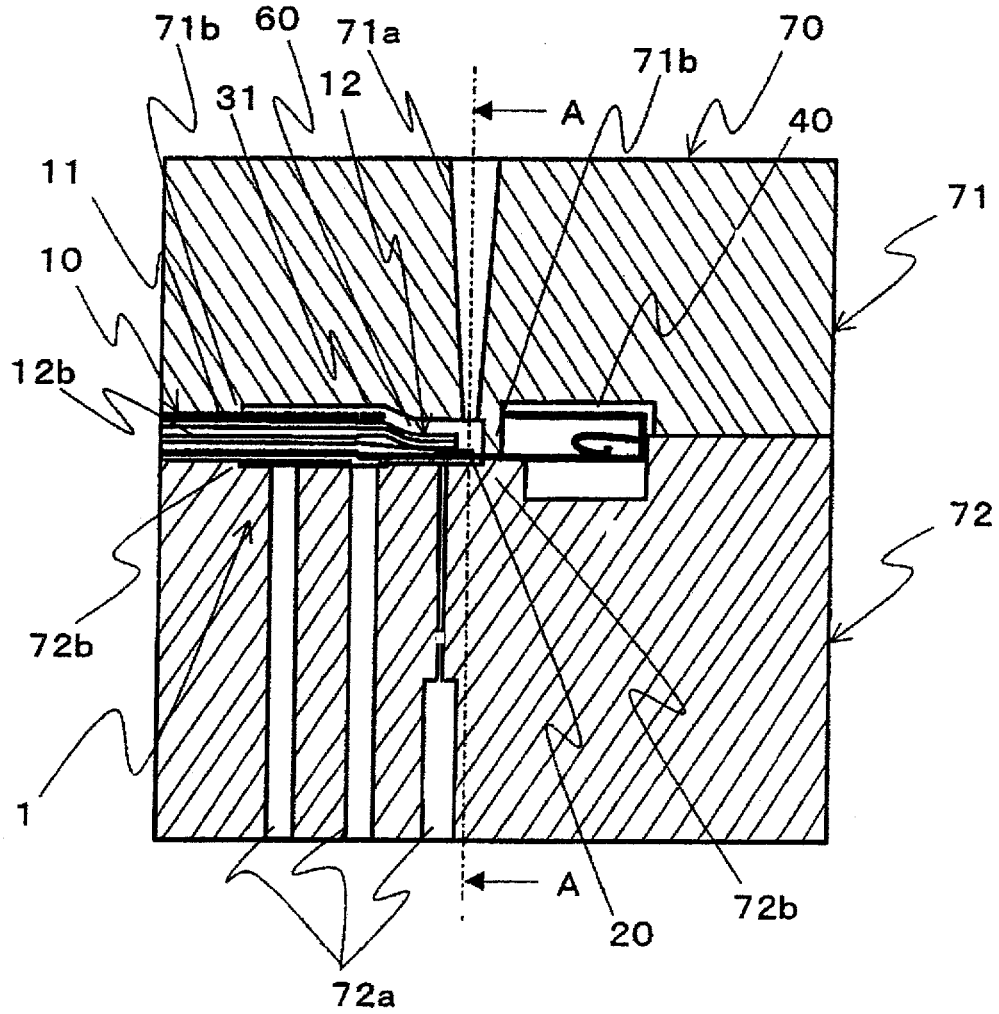
FIG. 4 is a main sectional view showing a metallic mold and the connection structure of the electric wire and the terminal.
Figure 5:
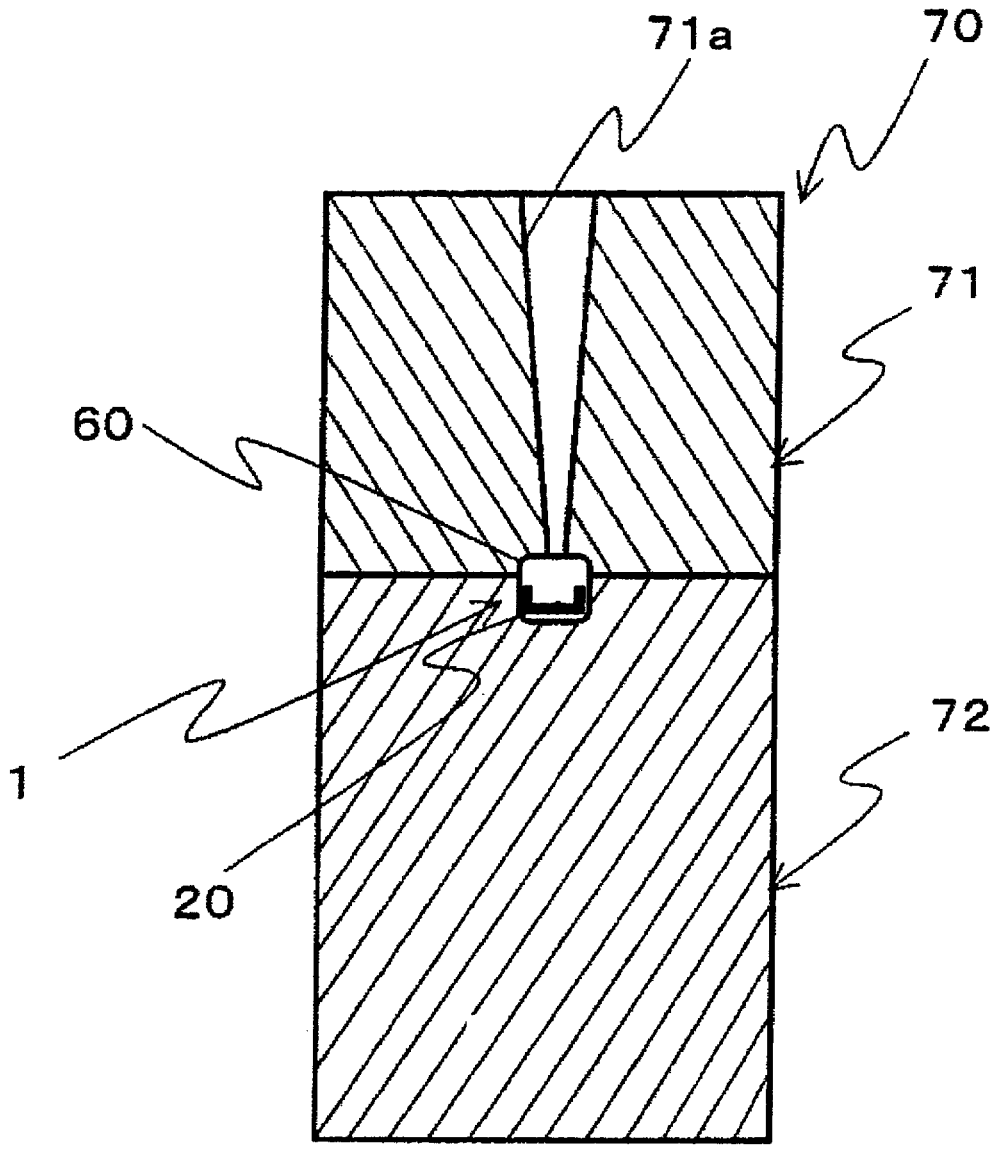
FIG. 5 is a sectional view taken on line A-A of the main sectional view shown in FIG. 4.

Here, the seal part 60 formed using a metallic mold 70 will concretely be described using FIGS. 4 and 5.

FIG. 4 is a main sectional view showing the metallic mold 70 and the connection structure 1 of the electric wire and the terminal. FIG. 5 is a sectional view taken on line A-A of the main sectional view shown in FIG. 4.

The metallic mold 70 is a metallic mold used generally, and has an upper metallic mold 71 and a lower metallic mold 72 as shown in FIG. 4. The upper metallic mold 71 has a gate 71*a* and flash cut parts 71*b*. The lower metallic mold 72 has pushpins 72*a* and flash cut parts 72*b*.

A position of the gate 71*a* is disposed in the vicinity of the end of the seal part 60 in order to enhance filling properties of thermoplastic elastomer in the end of the seal part 60.

As shown in FIG. 5, the thermoplastic elastomer which is the seal part 60 is formed so as to seamlessly cover the outer periphery the portion of connection between the electric wire and the terminal when viewed in a cross section orthogonal to the extension direction.

The connection structure 1 of the electric wire and the terminal of the first embodiment of the invention has the seal part 60 which is made of the thermoplastic elastomer and covers a surface including the insulation barrel 31 and the insulating coated part 11 of the side extending from the insulation barrel 31 toward a direction opposite to the end of the electric wire 10 and a surface of the wire barrel 32 in the extension direction of the electric wire 10, and the outer periphery of the electric wire 10 is seamlessly covered with the seal part 60 when viewed in a cross section orthogonal to the extension direction, so that peeling of the seal part 60 by an external force can be prevented to increase waterproof properties, with the result that corrosion-proof properties can be improved.

Also, in the connection structure 1 of the electric wire and the terminal of the first embodiment of the invention, the surface of the insulating coated part 11 of the side extending from the insulation barrel 31 toward the direction opposite to the end of the electric wire 10 is covered with the seal part 60, so that waterproof properties of the portion which tends to be bent can be improved. Further, since the thermoplastic elastomer having elasticity is used as the seal part 60, the thermoplastic elastomer becomes easy to follow the bending and thereby, peeling of the seal part 60 can be prevented to increase waterproof properties, with the result that corrosion-proof properties can be improved.

(Second Embodiment)

Figure 6A:
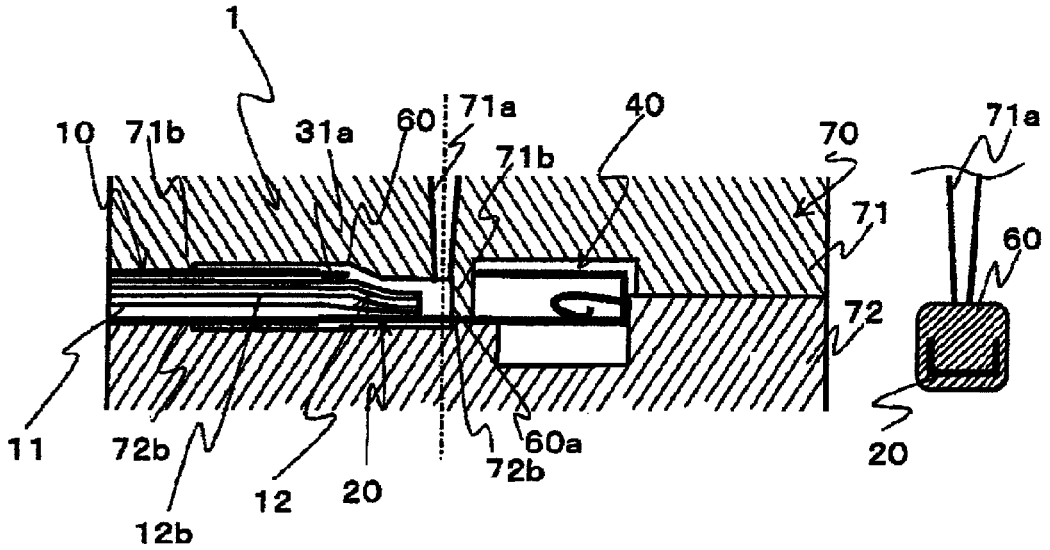
FIGS. 6A and 6B are diagrams describing a state of a seal part by separation of a gate in the case of arranging a position of the gate of a metallic mold in the vicinity of the end of the seal part.
Figure 6B:
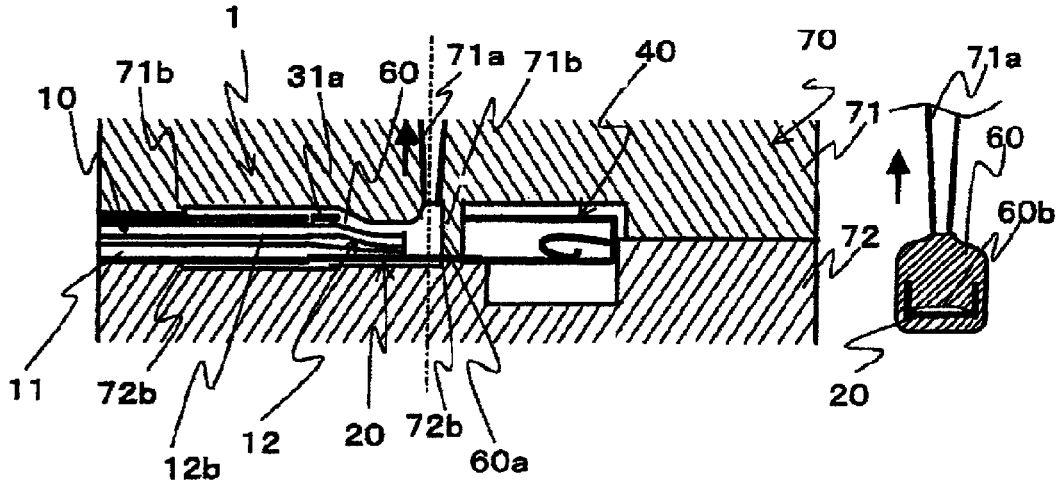
Figure 7:
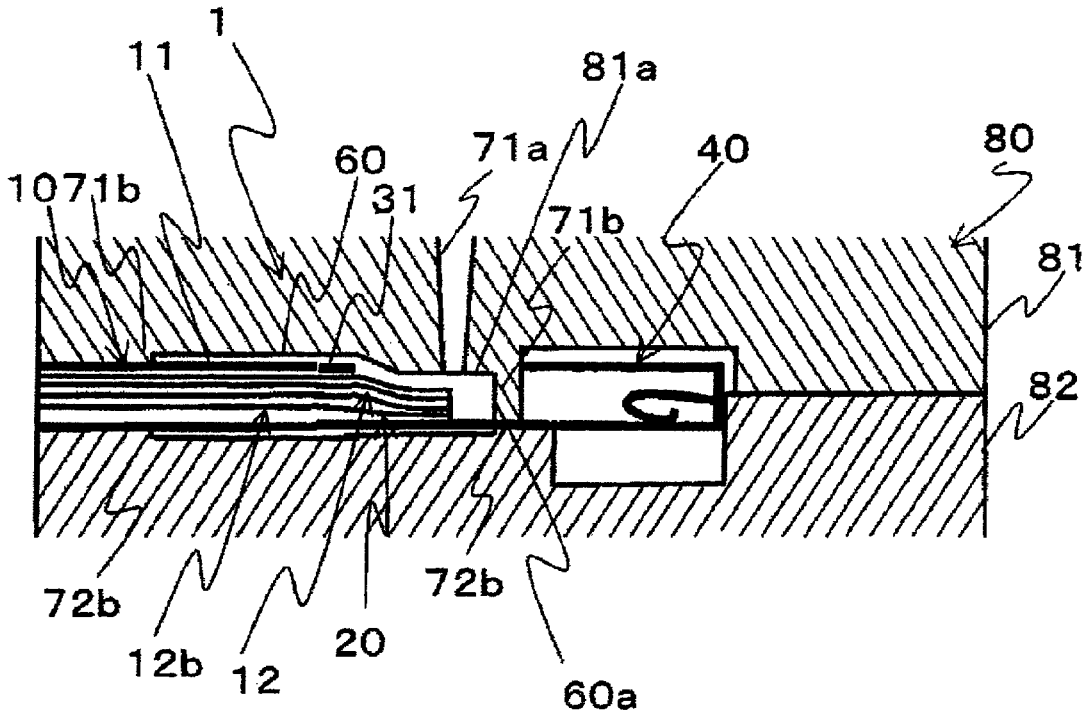
FIG. 7 is a diagram showing a metallic mold in which a position of a gate used in a manufacturing method of a connection structure of an electric wire and a terminal of a second embodiment of the invention is displaced, and the connection structure of the electric wire and the terminal.
Figure 8:
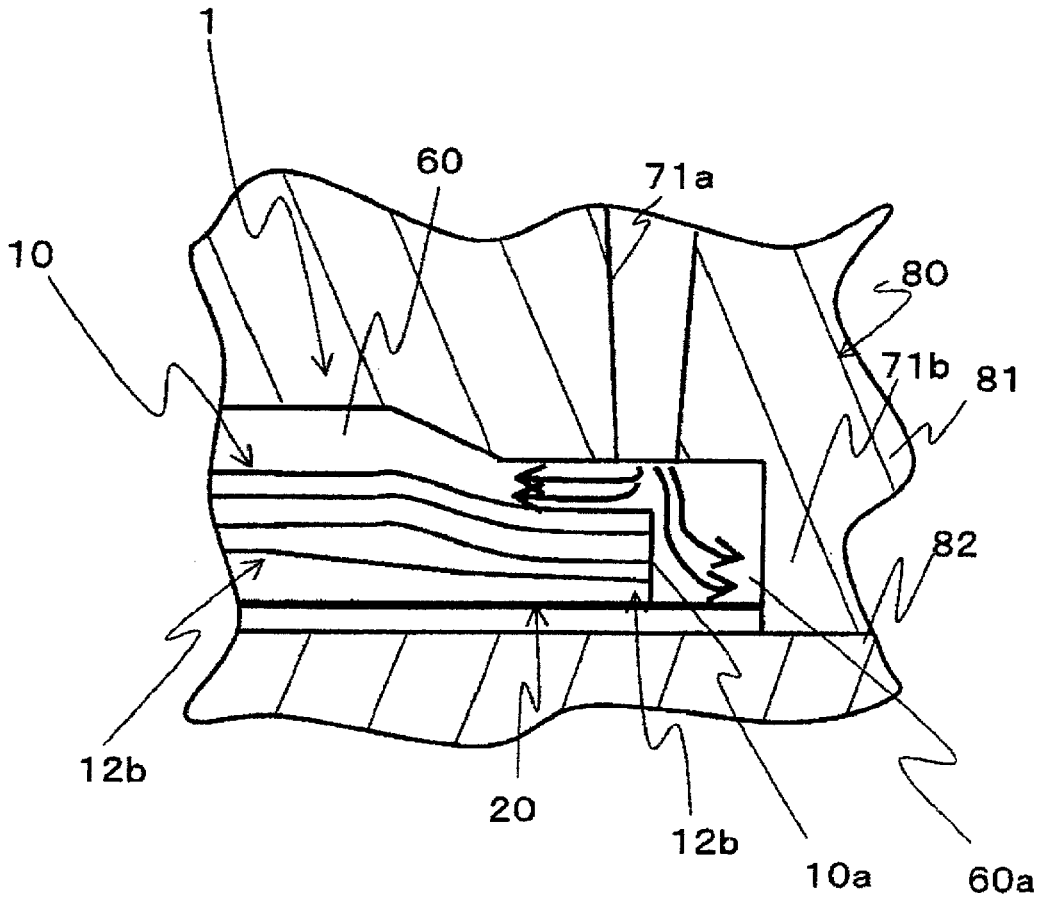
FIG. 8 is a diagram showing one example of the displaced position of the gate.

Next, a manufacturing method of a connection structure 1 of an electric wire and a terminal of a second embodiment of the invention will be described using FIGS. 6A to 8. FIGS. 6A and 6B are diagrams describing a state of a seal part 60 by separation of a gate 71*a* in the case of arranging a position of the gate 71*a* of a metallic mold 70 in the vicinity of the end of the seal part 60. FIG. 7 is a diagram showing the metallic mold 70 in which the position of the gate 71*a* used in the manufacturing method of the connection structure 1 of the electric wire and the terminal of the second embodiment of the invention is displaced, and the connection structure 1 of the electric wire and the terminal. FIG. 8 is a diagram showing one example of the displaced position of the gate 71*a*. In addition, in FIGS. 6A and 6B, a diagram arranged in the right side is a main sectional view of the diagram arranged in the left side.

Also, the same numerals are assigned to the same components as those of the first embodiment described above.

The first embodiment of the invention illustrates the case of arranging the gate 71*a* of the metallic mold 70 in the vicinity of the end of the seal part 60 when the seal part 60 using the metallic mold 70 is formed, but in this case, the end 60*a* of the seal part 60 tends to be pulled by separation of the gate 71*a* as shown in FIGS. 6A and 6B. As a result, while a terminal 20 is seamlessly covered with the seal part 60, peeling 60*b* of the seal part 60 may occur in the vicinity of this gate 71*a* as shown in the right diagram of FIG. 6B.

Hence, the manufacturing method of the connection structure 1 of the electric wire and the terminal of this second embodiment is constructed so that the gate 71*a* of the metallic mold 70 is arranged separately from a formation position of the end of the seal part 60 toward an extension direction of an electric wire 10 and the inside of the metallic mold 70 is filled with the seal part 60.

In a metallic mold 80 used in the manufacturing method of the connection structure 1 of the electric wire and the terminal of this second embodiment, the gate 71*a* is disposed in a position separate from a formation position of the end 60*a* of the seal part 60 toward the extension direction of the electric wire 10 as shown in FIG. 7. As a result, a surface of an upper metallic mold 81 abutting on the seal part 60 in the vicinity of the end 60*a* of the seal part 60 functions as a press part 81*a* used as a press, and the end 60*a* of the seal part 60 is prevented from being pulled by separation of the gate 71*a*.

In addition, it is more preferable to arrange the gate 71*a* in the surface extending to an end 10*a* of the electric wire 10 as shown in FIG. 8. When the gate 71*a* is arranged thus, thermoplastic elastomer becomes easy to flow to a position of a flash cut part 71*b* by an effect of a step by the end 10*a*, so that filling properties are not reduced.

In the connection structure 1 of the electric wire and the terminal manufactured using the metallic mold 80 shown in this second embodiment, while having an effect similar to the connection structure 1 of the electric wire and the terminal of the first embodiment, occurrence of peeling of the seal part 60 in the vicinity of the gate 71*a* of the metallic mold 80 can be prevented to increase waterproof properties, with the result that corrosion-proof properties can be improved.

(Third Embodiment)

Figure 9:
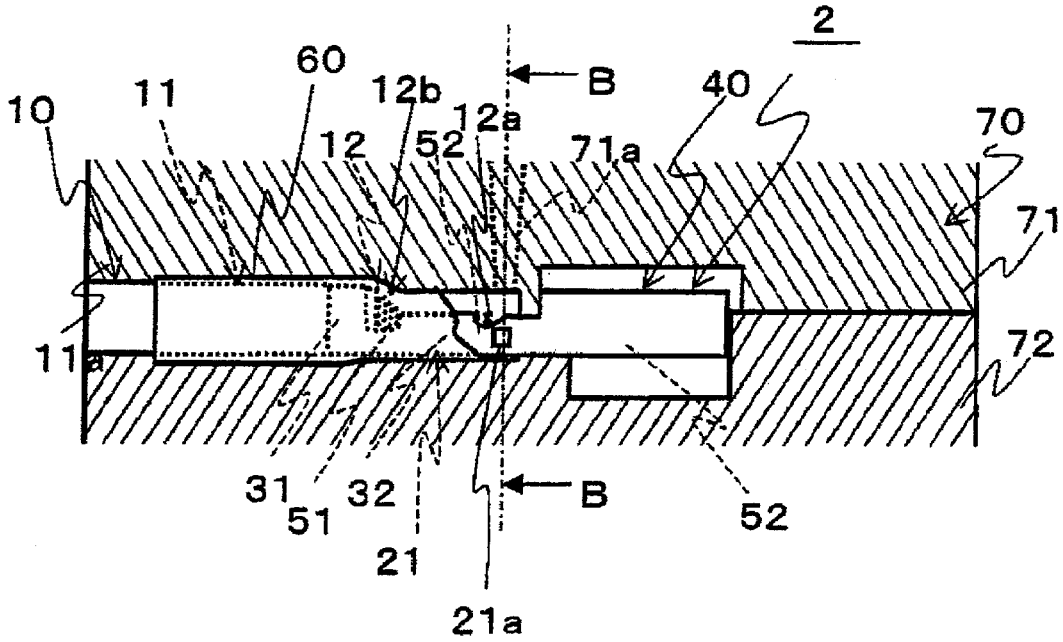
FIG. 9 is a diagram showing a connection structure of an electric wire and a terminal of a third embodiment of the invention.
Figure 10:
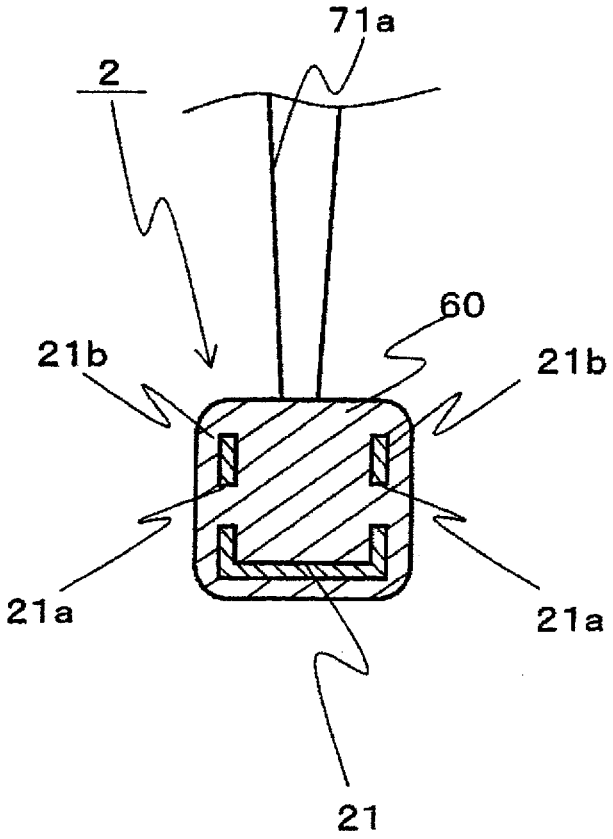
FIG. 10 is a sectional view taken on line B-B of the connection structure of the electric wire and the terminal shown in FIG. 9.

Next, a third embodiment of the invention will be described using FIGS. 9 and 10. FIG. 9 is a diagram showing a structure 2 of connection between an electric wire and a terminal of the third embodiment of the invention. FIG. 10 is a sectional view taken on line B-B of the structure 2 of connection between the electric wire and the terminal shown in FIG. 9.

Also, the same numerals are assigned to the same components as those of the first and second embodiments described above.

The structure 2 of connection between an electric wire 10 and a terminal 21 of this third embodiment has a configuration of preventing occurrence of peeling in the vicinity of the gate 71*a* described in the second embodiment. In the structure 2 of connection between the electric wire 10 and the terminal 21, a rectangular opening part 21*a* is formed in the terminal 21 as shown in FIG. 9.

The opening parts 21*a* are formed in side walls 21*b*, 21*b* covered with a seal part 60. More concretely, the opening parts 21*a* are formed in both the side walls 21*b*, 21*b* of the terminal 21 positioned in the lower vicinity of an upper metallic mold 71 in a state of being set in a metallic mold 70. Since the opening parts 21*a* are filled with thermoplastic elastomer of the seal part 60, the opening parts 21*a* prevent the seal part 60 from being pulled by separation of the gate 71*a*.

According to the structure 2 of connection between the electric wire 10 and the terminal 21 of this third embodiment, occurrence of peeling of the seal part 60 in the vicinity of the gate 71*a* of the metallic mold 70 can be prevented while having an effect similar to the connection structure 1 of the electric wire and the terminal of the first embodiment.

In addition, in the structure 2 of connection between the electric wire and the terminal of this third embodiment, the example of forming the opening parts 21*a* in the vicinity of the gate 71*a* is illustrated, but the example is not limited to this example. That is, the opening parts 21*a* could be formed in the side walls of the terminal 21 in which the seal part 60 is formed, that is, the side walls covered with the seal part 60. In this case, the seal part 60 of the inside and the outside of the side walls of the terminal 21 is joined through the seal part 60 with which the opening parts 21*a* are filled. The seal part 60 with which the opening parts 21*a* are filled functions as a holding part of the seal part 60 with respect to an external force. As a result, the structure 2 of connection between the electric wire and the terminal of this third embodiment can prevent peeling of the seal part 60 to increase waterproof properties, with the result that corrosion-proof properties can be improved.

Also, in this third embodiment, the example in which the opening part 21*a* has the rectangular shape is illustrated, but the example is not limited to this example. For example, the opening part 21*a* may have a circular shape.

(Fourth Embodiment)

Figure 11:
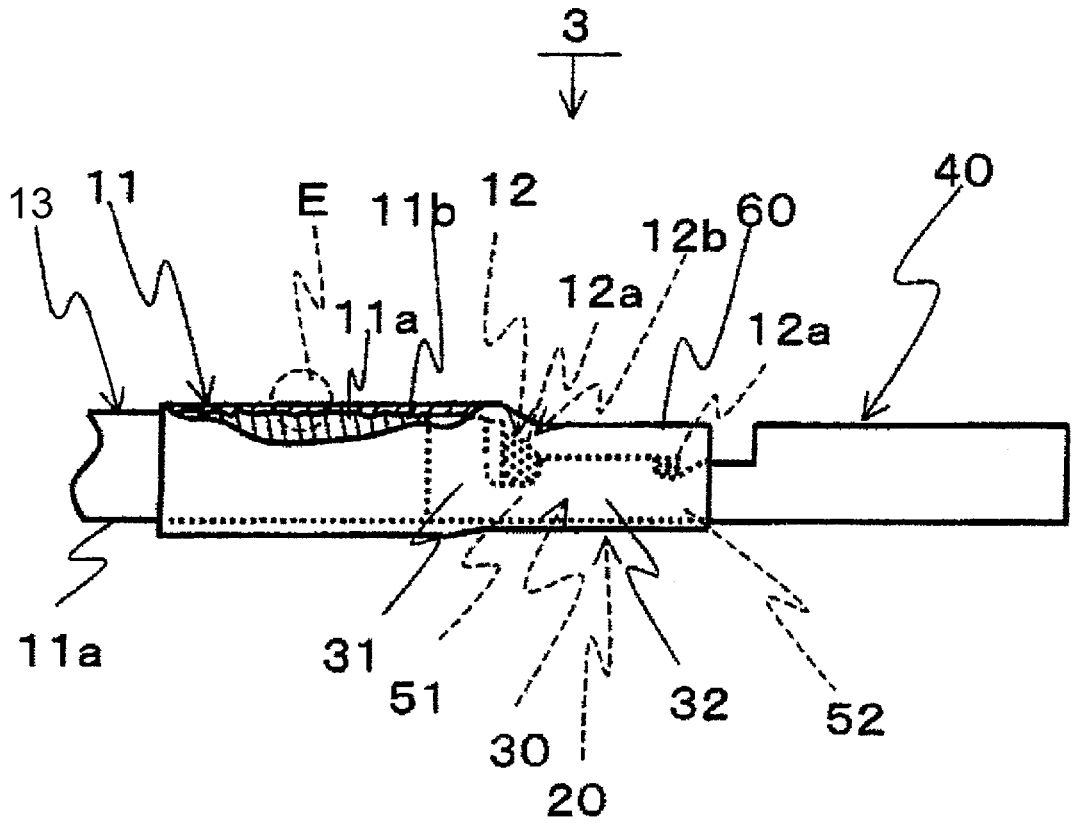
FIG. 11 is a diagram showing a connection structure of an electric wire and a terminal of a fourth embodiment of the invention.
Figure 12:
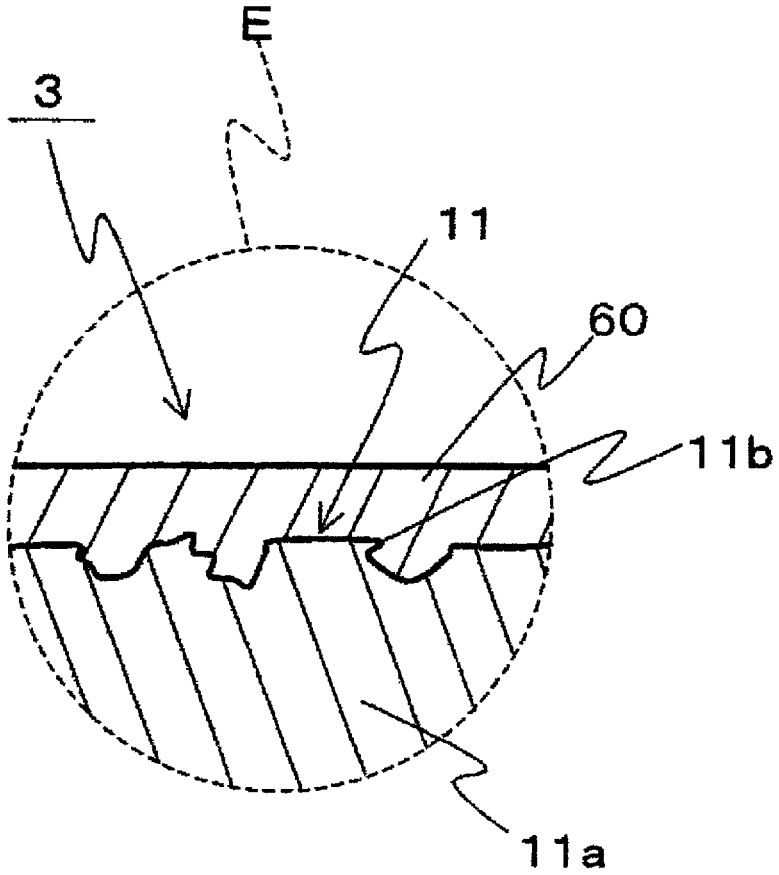
FIG. 12 is an enlarged sectional view of a part of adhesion between an insulating coated part and a seal part.

Next, a fourth embodiment of the invention will be described using FIGS. 11 and 12. FIG. 11 is a diagram showing a structure 3 of connection between an electric wire and a terminal of the fourth embodiment of the invention. FIG. 12 is an enlarged sectional view of a part E of adhesion between an insulating coated part 11 and a seal part 60.

Also, the same numerals are assigned to the same components as those of the first to third embodiments described above.

In the structure 3 of connection between the electric wire and the terminal of this fourth embodiment, a surface of the insulating coated part 11 of the side extending from an insulation barrel 31 toward a direction opposite to the end of an electric wire 13 has an uneven shape by roughening treatment as shown in FIG. 11. More concretely, a roughened surface 11*b* is formed by performing surface roughening treatment on the surface of an insulating part 11*a* covered with the seal part 60. This surface roughening treatment includes blast treatment, plasma treatment, etc.

The surface roughening treatment is performed after crimping or at the time of crimping or peeling the insulating part 11*a*. When the surface roughening treatment is performed at the time of peeling the insulating part 11*a*, for example, a surface of a clamp part of a crimper for clamping the electric wire 13 is formed in an uneven shape and a surface of contact with the electric wire 13 of the insulating part 11*a* is clamped and thereby, the surface roughening treatment can be performed without adding a process.

In the structure 3 of connection between the electric wire 13 and the terminal 20 of this fourth embodiment, the surface of the insulating part 11*a* covered with the seal part 60 has the uneven shape as shown in FIG. 12, so that a surface area of a surface of adhesion between the insulating part 11*a* and the seal part 60 increases and also the strength of adhesion between the insulating part 11*a* and the seal part 60 improves by an anchor effect caused by entrance of the seal part 60 into recesses of the surface of the insulating part 11*a*. That is, the structure 3 of connection between the electric wire and the terminal of this fourth embodiment can prevent peeling of the seal part 60 to increase waterproof properties, with the result that corrosion-proof properties can be improved.

(Fifth Embodiment)

Next, a fifth embodiment of the invention will be described using FIG. 13.

Figure 13:
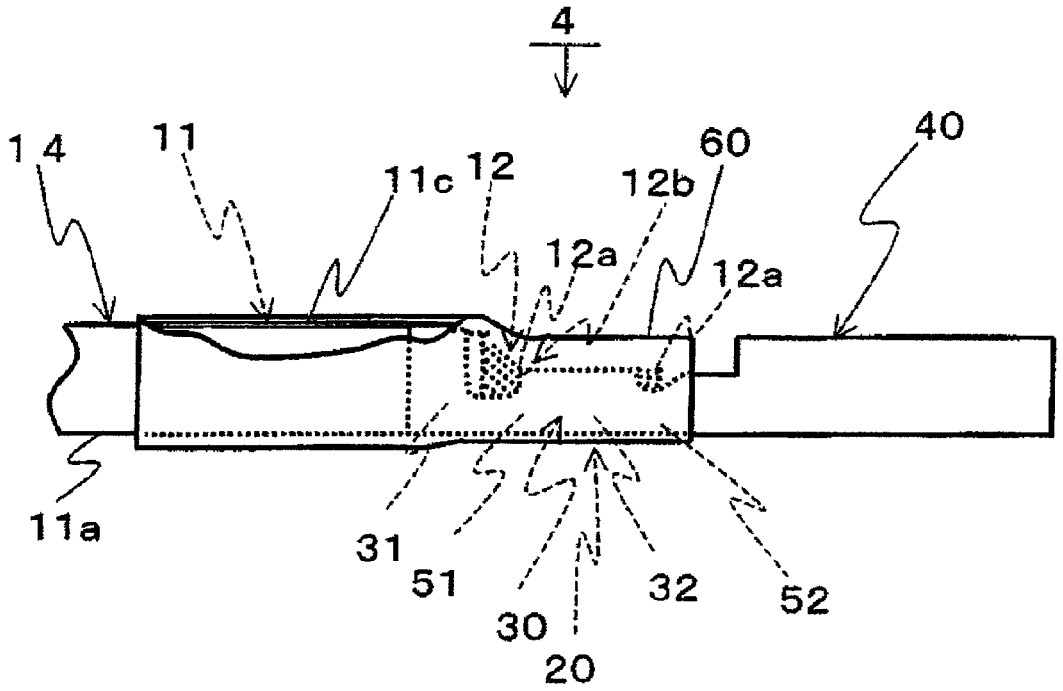
FIG. 13 is a diagram showing a connection structure of an electric wire and a terminal of a fifth embodiment of the invention.

FIG. 13 is a diagram showing a structure 4 of connection between an electric wire and a terminal of the fifth embodiment of the invention.

In addition, the same numerals are assigned to the same components as those of the embodiments described above.

In the structure 4 of connection between the electric wire and the terminal of this fifth embodiment, a substrate 11*c* is formed on a surface of an insulating coated part 11 of the side extending from an insulation barrel 31 toward a direction opposite to the end of an electric wire 14 as shown in FIG. 13. More concretely, on the surface of the insulating coated part 11 covered with a seal part 60, the substrate 11*c* is formed by applying an adhesive such as a primer.

In the structure 4 of connection between the electric wire and the terminal of this fifth embodiment, the strength of adhesion between the insulating coated part 11 and the seal part 60 is improved by forming the substrate 11*c* on the surface of the insulating coated part 11 covered with the seal part 60. As a result, peeling of the seal part 60 can be prevented to increase waterproof properties, with the result that corrosion-proof properties can be improved.

In addition, when ITRO (registered trademark) treatment is performed on the surface of the insulating coated part 11 as pretreatment in the case of forming this substrate 11*c*, wettability of the surface improves and the strength of adhesion between the insulating coated part 11 and the seal part 60 can be improved more.

Figure 14:
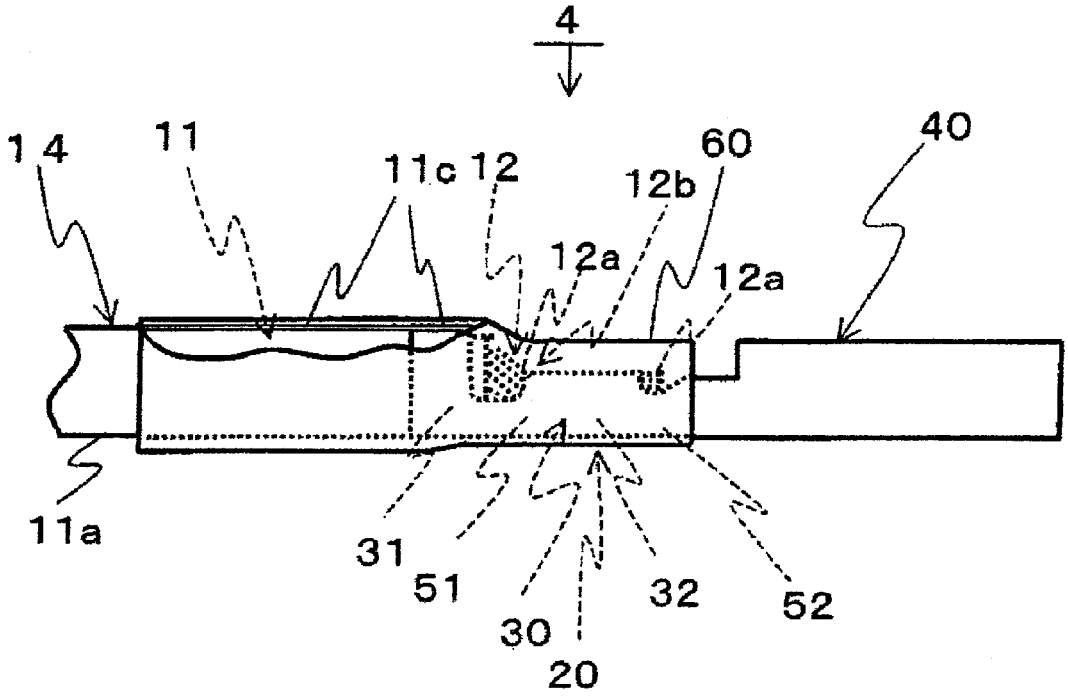
FIG. 14 is a diagram showing a modified example of the connection structure of the electric wire and the terminal of the fifth embodiment of the invention.

Also, the strength of adhesion between a terminal 20 and the seal part 60 can be improved by further performing pretreatment on a surface of the terminal 20 like the insulating coated part 11 as shown in FIG. 14.

(Sixth Embodiment)

Figure 15:
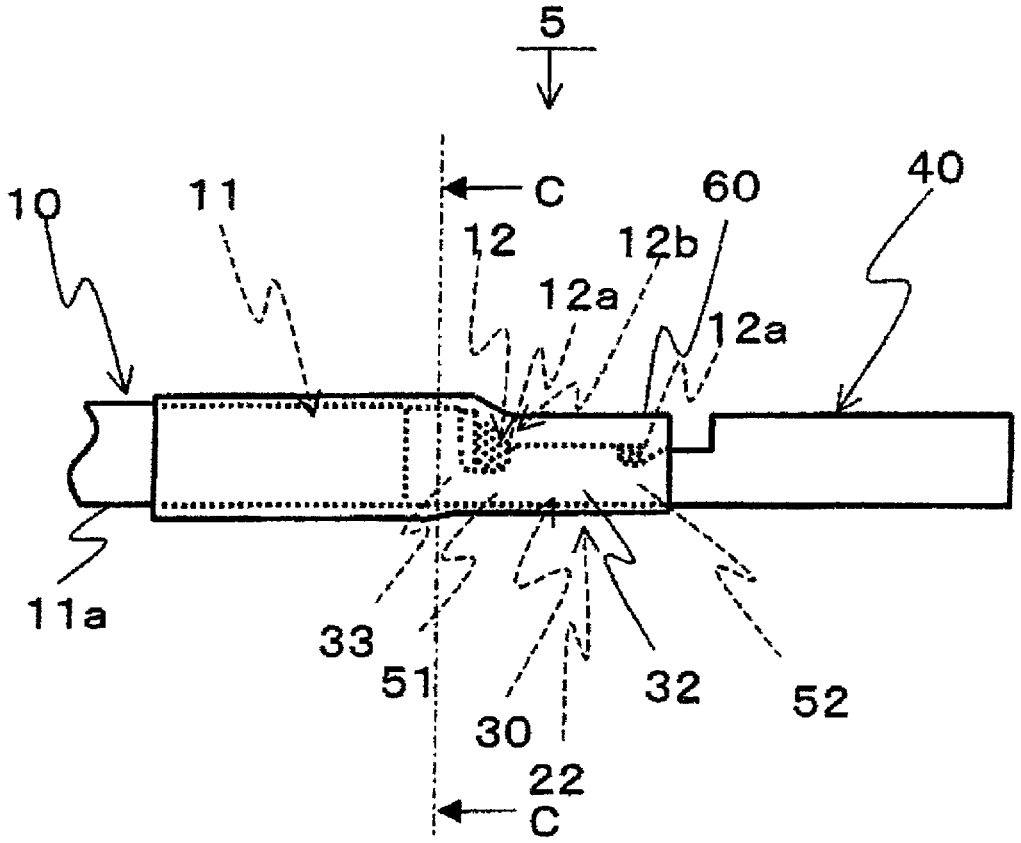
FIG. 15 is a diagram showing a connection structure of an electric wire and a terminal of a sixth embodiment of the invention.
Figure 16:
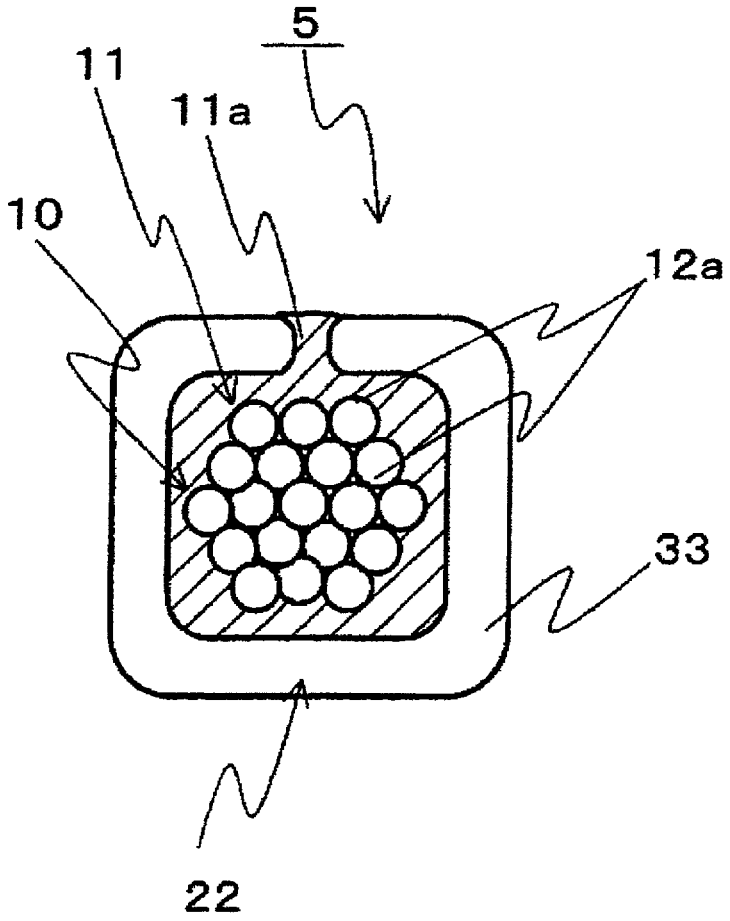
FIG. 16 is a sectional view taken on line C-C of the connection structure of the electric wire and the terminal shown in FIG. 15.
Figure 17:
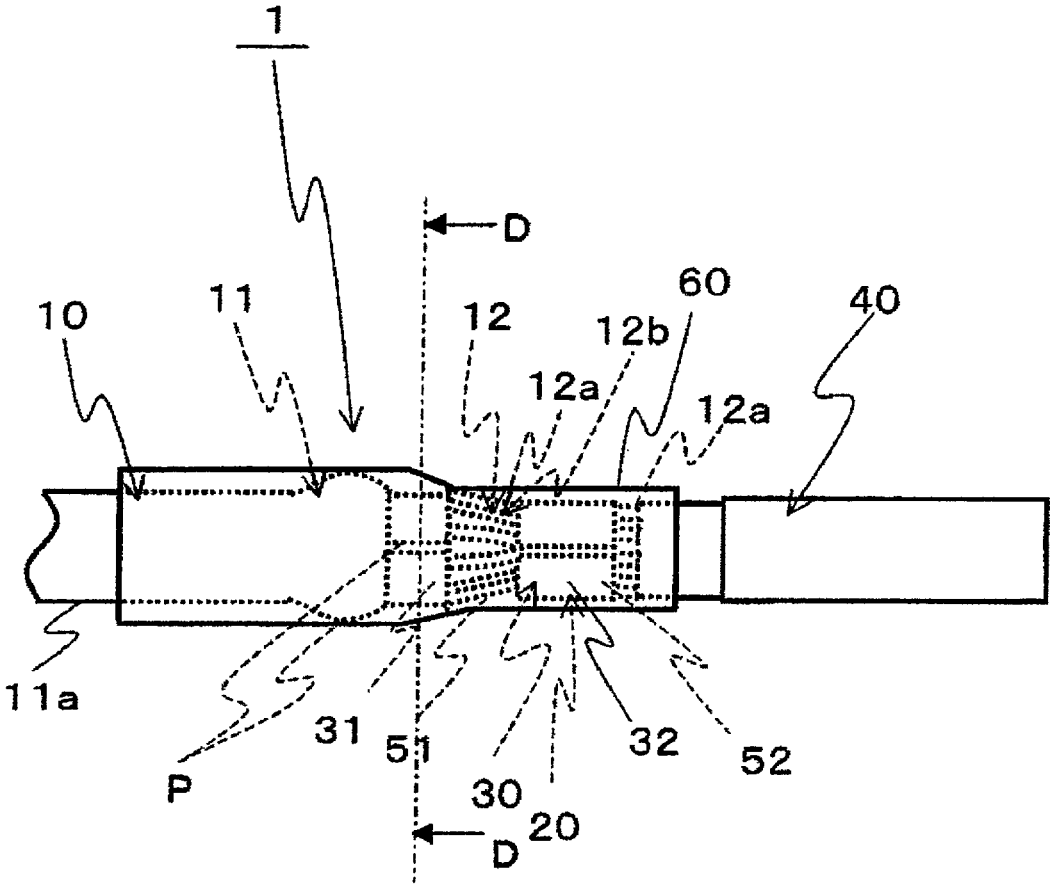
FIG. 17 is a diagram describing the fact that an insulating coated part swells in the vicinity of an insulation barrel.
Figure 18:
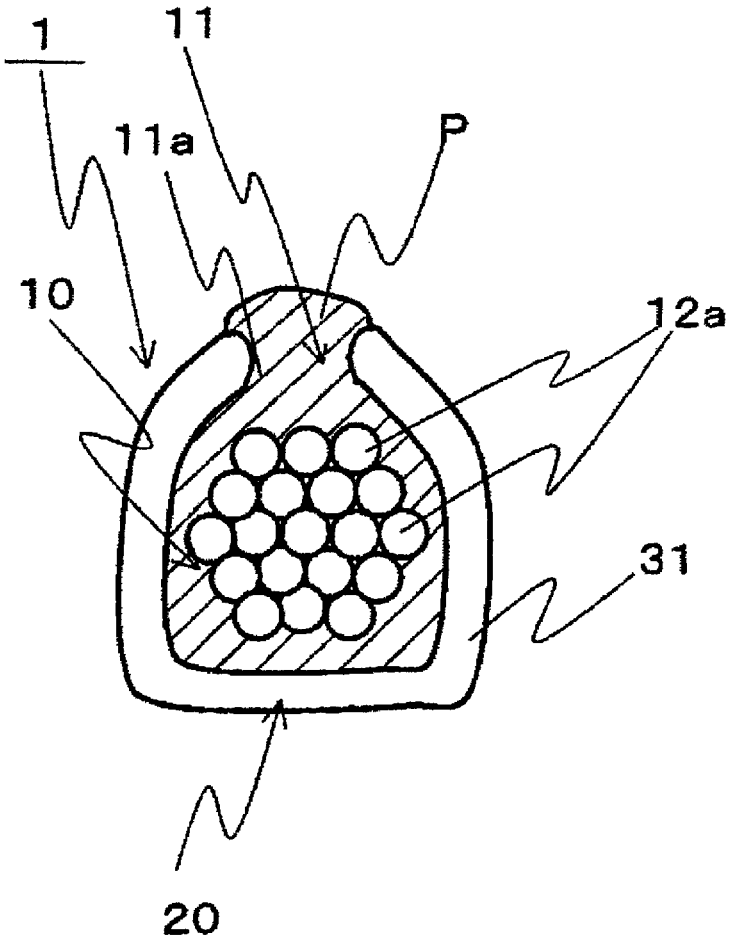
FIG. 18 is a sectional view taken on line D-D of the connection structure of the electric wire and the terminal shown in FIG. 17.
Figure 19:
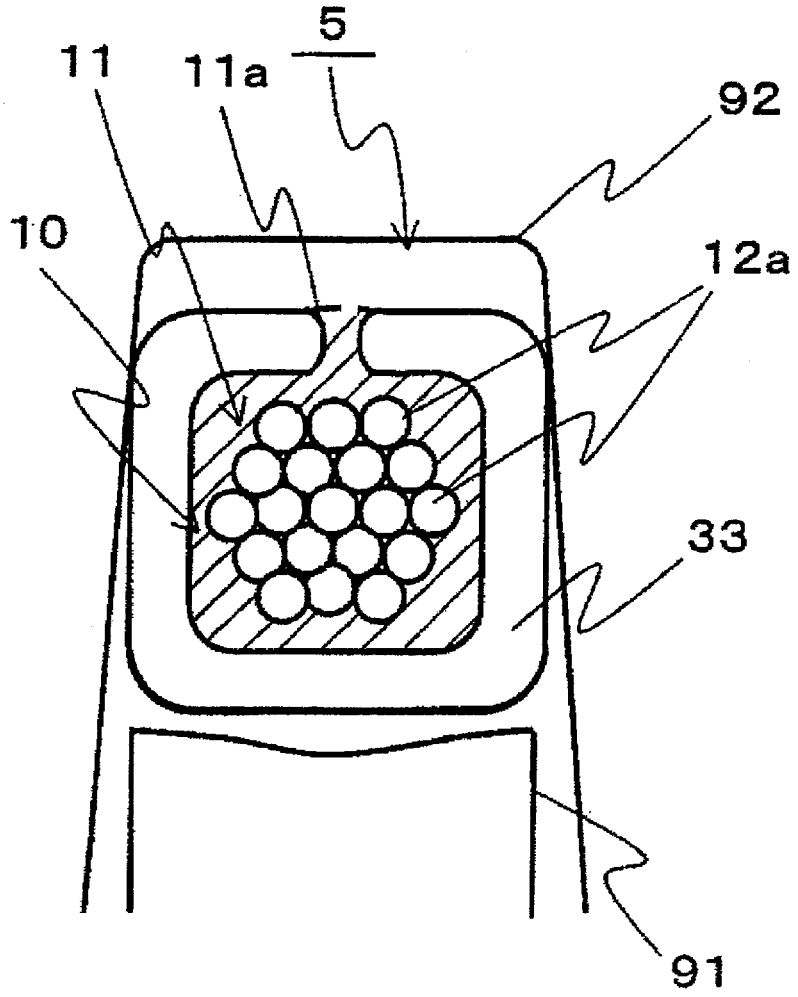
FIG. 19 is a diagram describing an anvil and a crimper used in crimping of the insulation barrel.
Figure 20:
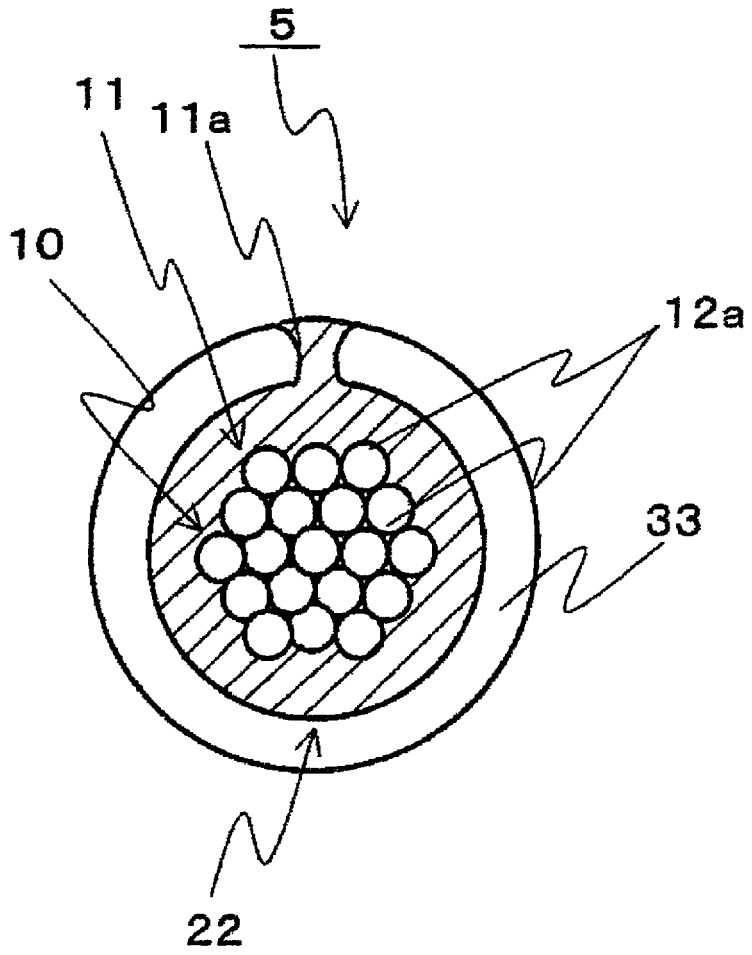
FIG. 20 is a diagram showing a modified example of the connection structure of the electric wire and the terminal of the sixth embodiment of the invention.

Next, a sixth embodiment of the invention will be described using FIGS. 15 to 20. FIG. 15 is a diagram showing a structure 5 of connection between an electric wire and a terminal of the sixth embodiment of the invention. FIG. 16 is a sectional view taken on line C-C of the structure 5 of connection between the electric wire and the terminal shown in FIG. 15. FIG. 17 is a diagram describing the fact that an insulating coated part 11 swells in the vicinity of an insulation barrel 31. FIG. 18 is a sectional view taken on line D-D of the connection structure 1 of the electric wire and the terminal shown in FIG. 17. FIG. 19 is a diagram describing an anvil 91 and a crimper 92 used in crimping of the insulation barrel 31. FIG. 20 is a diagram showing a modified example of the structure 5 of connection between the electric wire and the terminal of the sixth embodiment of the invention.

Also, the same numerals are assigned to the same components as those of the first to fifth embodiments described above.

In the connection structure 1 of the electric wire 10 and the terminal 20 of the first embodiment of the invention, an insulating part 11*a* swells in the vicinity of the portion of crimping the insulation barrel 31 as shown in FIGS. 17 and 18. As a result, a swelling portion P of the insulating part 11*a* inhibits formation of the seal part 60 and a thickness of the seal part in the swelling portion P becomes thin, with the result that waterproof properties decrease.

Hence, in the structure 5 of connection between the electric wire and the terminal of this sixth embodiment, an external shape of a cross section orthogonal to an extension direction of the electric wire 10 is formed in a rectangular shape as shown in FIG. 16. That is, in an insulation barrel 33, the external shape of the cross section orthogonal to the extension direction of the electric wire 10 is formed in the rectangular shape and a cross-sectional area orthogonal to the extension direction of the electric wire 10 surrounded by the insulation barrel 33 is increased. When the insulation barrel 33 is formed thus, for example, the insulation barrel is crimped using the anvil 91 and the crimper 92 shown in FIG. 19.

Since the structure 5 of connection between the electric wire and the terminal of this sixth embodiment is constructed so as to increase the cross-sectional area orthogonal to the extension direction of the electric wire 10 surrounded by the insulation barrel 33, the insulating part 11*a* is prevented from swelling in the vicinity of the portion of crimping the insulation barrel 33 and a thickness of the seal part 60 is prevented from becoming thin, so that waterproof properties can be increased, with the result that corrosion-proof properties can be improved.

In addition, in the structure 5 of connection between the electric wire and the terminal of the sixth embodiment of the invention, the example in which the external shape of the cross section orthogonal to the extension direction of the electric wire 10 is formed in the rectangular shape is illustrated, but the example is not limited to this example. That is, the insulation barrel 31 could be formed so as to increase the cross-sectional area orthogonal to the extension direction of the electric wire 10 surrounded by the insulation barrel 31. For example, the insulation barrel 33 may be formed so that the external shape of the cross section orthogonal to the extension direction of the electric wire 10 is formed in a circular shape as shown in FIG. 20.

(Seventh Embodiment)

Figure 21:
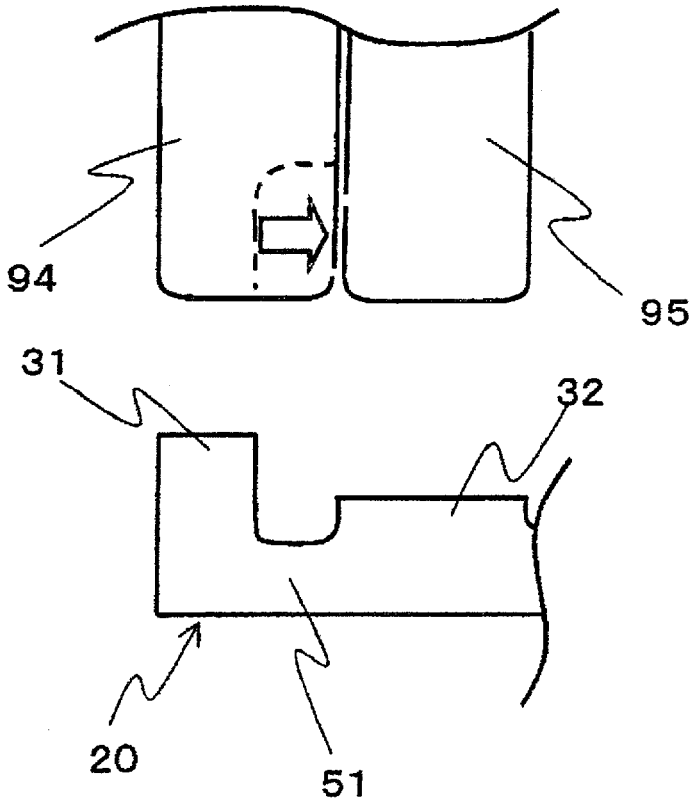
FIG. 21 is a main side view of a terminal before the terminal is crimped, an insulation crimper and a wire crimper of a seventh embodiment of the invention.
Figure 22:
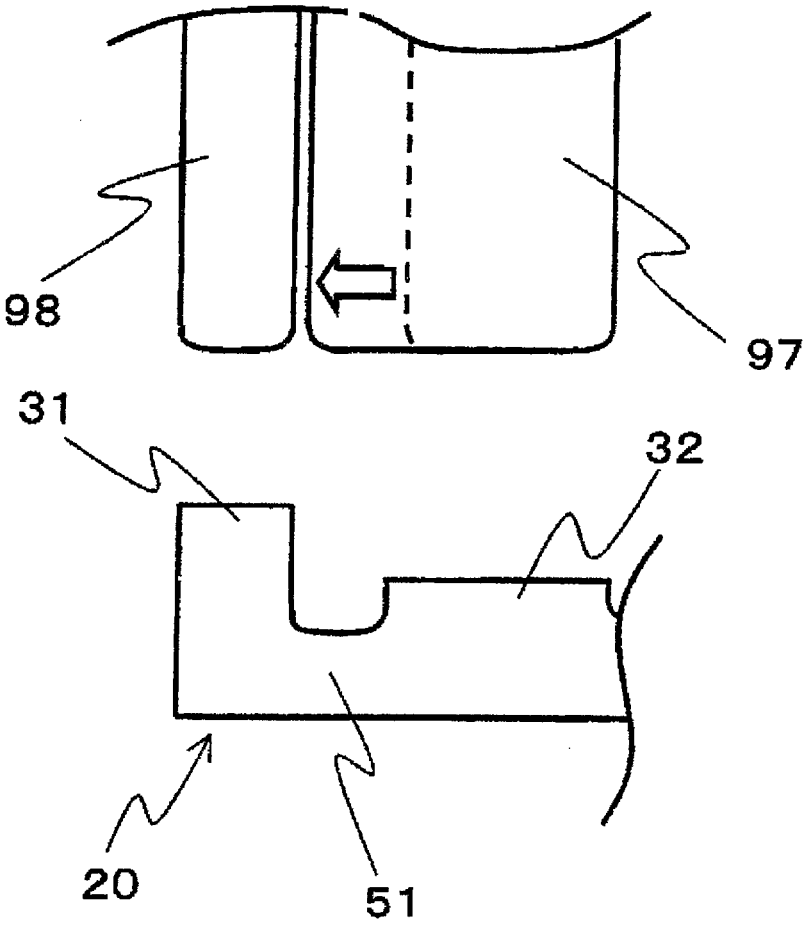
FIG. 22 is a main side view of the terminal before the terminal is crimped, an insulation crimper and a wire crimper of the seventh embodiment of the invention.
Figure 23:
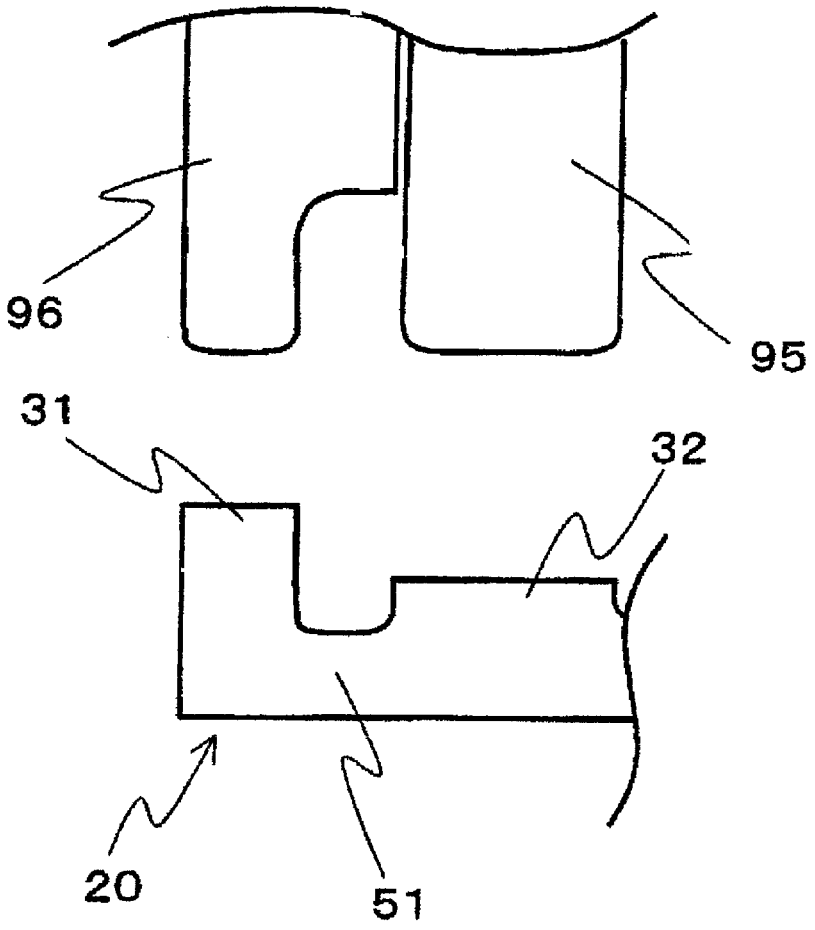
FIG. 23 is a main side view of the terminal before the terminal is crimped, an insulation crimper and a wire crimper.
Figure 24:
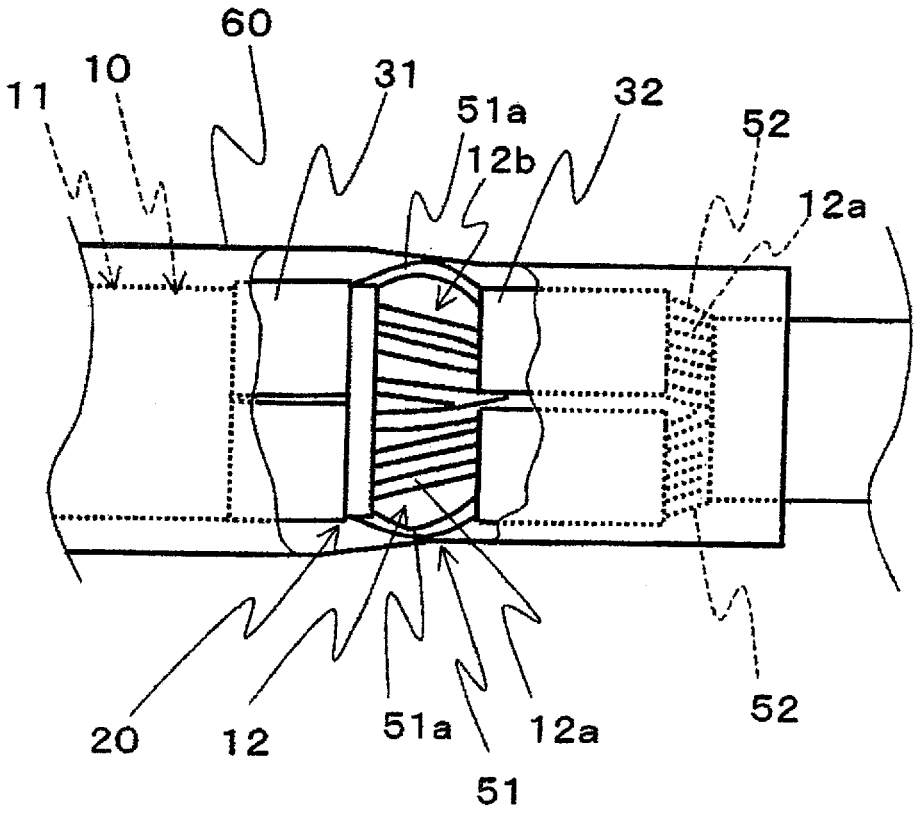
FIG. 24 is a diagram describing the fact that a notched part swells.
Figure 25:
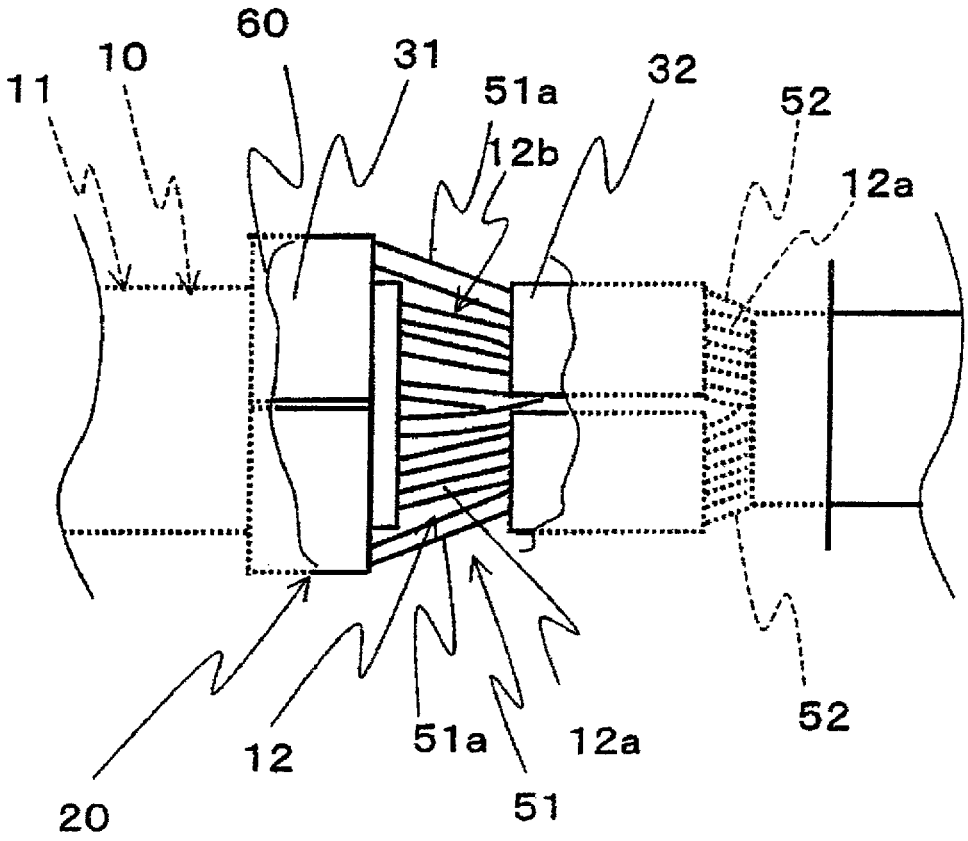
FIG. 25 is a diagram showing a normal crimp state of the terminal.

Next, a seventh embodiment of the invention will be described using FIGS. 21 to 25. FIG. 21 is a main side view showing a terminal 20 before the terminal is crimped, an insulation crimper 94 and a wire crimper 95 of the seventh embodiment of the invention. FIG. 22 is a main side view showing the terminal 20 before the terminal is crimped, an insulation crimper 98 and a wire crimper 97 of the seventh embodiment of the invention. FIG. 23 is a main side view showing the terminal 20 before the terminal is crimped, an insulation crimper 96 and the wire crimper 95. FIG. 24 is a diagram describing the fact that a notched part 51 swells. FIG. 25 is a diagram showing a normal crimp state of the terminal 20.

Also, the same numerals are assigned to the same components as those of the first to sixth embodiments described above.

Conventionally, a width (C/W) after crimping an insulation barrel 31 is set more widely than a wire barrel 32 as shown in FIG. 25. This is because the insulation barrel 31 is crimped to an insulating coated part 11 coated with an insulating part 11*a* and the wire barrel 32 is crimped to a conductor exposed part 12 in which the insulating part 11*a* is removed. Also, each of the crimpers 95, 96 is constructed so as to press inside the surfaces of the insulation barrel 31 and the wire barrel 32 as shown in FIG. 23.

As a result, when the wire barrel 32 and the insulation barrel 31 are respectively crimped by the wire crimper 95 and the insulation crimper 96 and become the same width (C/W), or when the insulation barrel 31 becomes the width (C/W) narrower than the wire barrel 32, the insulation barrel 31 tends to escape to the notched part 51 without the press as shown in FIG. 24, so that side walls 51*a*, 51*a* of the notched part 51 swell.

When the side walls 51*a*, 51*a* of the notched part 51 swell thus, a film thickness of a seal part 60 of the swelling portion is formed thinly, with the result that waterproof properties decrease.

Hence, in a manufacturing method of the connection structure 1 of the electric wire and the terminal of this seventh embodiment, as shown in FIG. 21, a width of the insulation crimper 94 as crimp means is increased and the notched part 51 is covered in the case of crimping.

Consequently, in the case of crimping by pressing a crimp surface of the insulation crimper 94 to the insulation barrel 31, the insulation barrel 31 is crimped while covering the notched part 51 with the crimp surface of the insulation crimper 94.

In the manufacturing method of the connection structure 1 of the electric wire and the terminal of this seventh embodiment, the insulation barrel 31 is crimped while covering the notched part 51 with the crimp surface of the insulation crimper 94 by increasing the width of the insulation crimper 94, so that the notched part 51 is prevented from swelling, with the result that a thickness of the seal part 60 is prevented from becoming thin. As a result, the connection structure 1 of the electric wire and the terminal of this seventh embodiment can increase waterproof properties, with the result that corrosion-proof properties can be improved.

In addition, in the manufacturing method of the connection structure 1 of the electric wire and the terminal of this seventh embodiment, the example of covering the notched part 51 by increasing the width of the insulation crimper 94 is illustrated, but the example is not limited to this example. That is, the wire barrel 32 may be crimped while covering the notched part 51 with a crimp surface of the wire crimper 97 by increasing a width of the wire crimper 97 and covering the notched part 51 as shown in FIG. 22.

In addition, in the first to seventh embodiments of the invention, the example in which the terminals 20, 21, 22 are copper is illustrated, but the example is not limited to this example. For example, the terminal made of an alloy of copper and nickel may be used.

Also, in the first to seventh embodiments of the invention, the example in which the structures 1, 2, 3, 4, 5 of connection between the electric wire and the terminal have the first notched part 51 and the second notched part 52 is illustrated, but the example is not limited to this example. That is, a terminal structure in which the notched part 50 is not provided may be used.

Also, in the first to seventh embodiments of the invention, the example in which the seal part 60 is formed so as not to have seams of the surface including the insulation barrel 31 and the insulating coated part 11 of the side extending from the insulation barrel 31 toward the direction opposite to the end of the electric wire 10, the surface of the wire barrel 32, the surface of the first notched part 51 and the second notched part 52 in the extension direction of the electric wire 10 is illustrated, but the example is not limited to this example. That is, the seal part 60 may be separated in the extension direction of the electric wire 10.

In addition, this invention is not limited by the embodiments.

The invention is applicable to provide a connection structure of an electric wire and a terminal capable of improving corrosion-proof properties.

REFERENCE SIGNS LIST

1,2,3,4,5 CONNECTION STRUCTURE OF ELECTRIC WIRE AND TERMINAL
10,13,14 ELECTRIC WIRE
10*a* END
11 INSULATING COATED PART
11*a* INSULATING PART
11*b* ROUGHENED SURFACE
11*c* SUBSTRATE WITH IMPROVED ADHESION
12 CONDUCTOR EXPOSED PART
12*a* CORE WIRE
12*b* CONDUCTOR PART
20,21,22 TERMINAL
21*a* OPENING PART
30 ELECTRIC WIRE CONNECTION PART
31,33 INSULATION BARREL
32 WIRE BARREL
40 OTHER TERMINAL CONNECTION PART
50,51,52 NOTCHED PART
60 SEAL PART
60*a* END
70,80 METALLIC MOLD
71,81 UPPER METALLIC MOLD
71*a* GATE
71*b*,72*b* FLASH CUT PART
72,82 LOWER METALLIC MOLD
72*a* PUSHPIN
81*a* PRESS PART
91 ANVIL
92 CRIMPER
94,96,98 INSULATION CRIMPER
95,97 WIRE CRIMPER

What is claimed is:

1. A connection structure of an electric wire and a terminal, comprising:

the electric wire having an insulating coated part in which a conductor part is covered with an insulating material, and a conductor exposed part in which the insulating material of an end of the electric wire is removed, and the terminal including a first crimp part crimped to the insulating coated part, and a second crimp part crimped to the conductor exposed part, and a seal part which is made of thermoplastic elastomer and covers a surface including the first crimp part and the insulating coated part of a side extending from said first crimp part toward a direction opposite to the end of the electric wire and a surface of the second crimp part in an extension direction of the electric wire, such that an outer periphery of the electric wire is seamlessly covered with the seal part when viewed in a cross section orthogonal to the extension direction of the electric wire;

wherein a surface of the insulating coated part of a side extending from the first crimp part toward a direction opposite to an end of the electric wire has an uneven shape by roughening treatment, and the seal part extends along the surface having an uneven shape by roughening treatment; and wherein a substrate with improved adhesion is formed on a surface of the terminal and on a surface of the insulating coated part by applying a primer agent.

2. The connection structure of an electric wire and a terminal as claimed in claim 1, wherein the terminal has a box shape and has a notched part in which a notch is formed in an upper part between the first crimp part and the second crimp part, and an outer periphery of the electric wire in the notched part is seamlessly covered with the seal part when viewed in the cross section orthogonal to the extension direction of the electric wire.

3. The connection structure of an electric wire and a terminal as claimed in claim 1, wherein the terminal has a box shape and an opening is formed in a side wall covered with the seal part.

4. The connection structure of an electric wire and a terminal as claimed in claim 1, wherein the first crimp part is formed so as to increase a cross-sectional area orthogonal to an extension direction of the electric wire surrounded by said first crimp part.

5. The connection structure of an electric wire and a terminal as claimed in claim 1, wherein an external shape of a cross section orthogonal to an extension direction of the electric wire is a rectangular shape in the first crimp part.

6. The connection structure of an electric wire and a terminal as claimed in claim 1, wherein the conductor part is made of aluminum, and the terminal is made of metal different from that of the conductor part.

7. A manufacturing method of a connection structure of an electric wire and a terminal, the electric wire having an insulating coated part in which a conductor part is covered with an insulating material, and a conductor exposed part in which the insulating material of an end of the electric wire is removed, and the terminal including a first crimp part crimped to the insulating coated part, and a second crimp part crimped to the conductor exposed part, the method comprising:

forming the seal part which is made of thermoplastic elastomer and covers a surface including the first crimp part and the insulating coated part of a side extending from said first crimp part toward a direction opposite to the end of the electric wire and a surface of the second crimp part in an extension direction of the electric wire so as to seamlessly cover an outer periphery of the electric wire when viewed in a cross section thereof by a metallic mold, the forming the seal part includes arranging a gate of the metallic mold separately from a formation position of an end of the seal part toward the extension direction of the electric wire and the inside of the metallic mold is filled with the seal part, wherein the gate is aligned with an end of the conductor exposed part of the electric wire.

* * * * *